US005484228A

United States Patent [19]

Thomas et al.

[11] Patent Number: 5,484,228

[45] Date of Patent: Jan. 16, 1996

[54] CONTINUOUS MOVING HIGHWAY DEPRESSION CUTTING APPARATUS AND METHOD

[76] Inventors: Glen E. Thomas; Amona D. Thomas, both of 1111 Riverside Dr., Moore Haven, Fla. 33471

[21] Appl. No.: 391,708

[22] Filed: Feb. 21, 1995

Related U.S. Application Data

[63] Continuation-in-part of Ser. No. 118,961, Sep. 10, 1993, Pat. No. 5,391,017.

[51] Int. Cl.[6] ..... E01C 23/09

[52] U.S. Cl. ..... 404/90; 404/72; 404/93; 404/94

[58] Field of Search ..... 404/72, 90, 93, 404/94; 299/38, 39

[56] References Cited

U.S. PATENT DOCUMENTS

| | | | |
|---|---|---|---|
| 4,701,069 | 10/1987 | Whitney | 404/75 |
| 4,793,732 | 12/1988 | Jordon | 404/90 |
| 4,797,025 | 1/1989 | Kennedy | 404/90 |
| 4,896,995 | 1/1990 | Simmons | 404/90 |
| 5,046,890 | 9/1991 | Dickson | 404/90 |
| 5,059,061 | 10/1991 | Stenemann et al. | 404/72 |
| 5,094,565 | 3/1992 | Johnson | 404/75 |
| 5,161,910 | 11/1992 | O'Konek | 404/90 |
| 5,259,692 | 11/1993 | Beller et al. | 404/90 |
| 5,297,894 | 3/1994 | Yenick | 404/90 |
| 5,391,017 | 2/1995 | Thomas et al. | 404/90 |
| 5,415,495 | 5/1995 | Johnson | 404/84.05 |

*Primary Examiner*—Ramon S. Britts
*Assistant Examiner*—Pamela A. O'Connor

[57] ABSTRACT

The use of a cam member having a plurality of camming groups to cause a raising and lowering motion to be transferred to a cutting head to install a series of SNAP depressions in the surface of an asphalt road. Two cutting methods are disclosed, the first allowing cutting through the cut, the second allowing a near plunge cut to be made. Cutting through the cut permits a smaller diameter cutting drum than would fit the resulting cut while providing for a smooth action to the cutting procedure. A near plunge cut permits adaptation of existing equipment utilizing current use cutting drum which diameter approximate the shape of the resulting cut. Proper spacing is ensured by having the cam member in direct communication with the surface under treatment with movement provided by the installing machine. The optional adaptation of a skip pattern within the series is taught. Various procedures to transfer the camming action to the cutting head are explained including direct transfer, reverse transfer and exaggerated transfer.

21 Claims, 19 Drawing Sheets

30
34
36
64
62
100
68
70
74
80
78
76
40
102
66
32
72
110
42
112
142
146
44
38

30
34
36
200
64
62
68
70
74
80
78
76
244
246
66
32
72
246
42
40
202
242
44
38

CONTINUOUS MOVING HIGHWAY DEPRESSION CUTTING APPARATUS AND METHOD

This application is a continuation-in-part application of U.S. Ser. No. 08/118,961, filed Sep. 10, 1993, now U.S. Pat. No. 5,391,017.

BACKGROUND

1. Field of the Invention

The field of the invention relates to installing a series of uniformly sized and spaced depressions, or SNAP's, in the surface of an asphalt road. The installation uses a cutting head and a cam member, the cam member having a plurality of camming groups, to form the desired series. Such installation being performed without requiring pausing the machine during installation. Means to milling through each cut or making plunge cuts, or near plunge cuts, is provided. Additionally, the optional placement of skip patterns within the series of depressions is provided.

2. Description of the Prior Art

Sonic noise alert pattern, (SNAP), are a series of depressions formed in the surface of asphalt. The pattern has the purpose of providing vibration, and therefore noise, when the tires of a vehicle traverse them longitudinally. Road departments use these depressions as a safety device. Longitudinally adjacent the edge of a highway or along the center line which divides the opposing directional traffic flows are common locations of placement. They act to alert a driver that his or her vehicle has extended beyond the normal driving surface. Beyond this normal driving surface many dangerous conditions exist for a vehicle traveling near the posted speed limit. These dangers include dirt or gravel shoulders, guardrail barriers, signs, mailboxes, intersecting roadways or driveways and disabled vehicles.

The various specifications for the placement and physical dimensions of the individual depressions can vary from state to state and even within a particular state. A common size and placement, used only for illustration and not limitation, places the individual depressions twelve inches apart from center of one depression to center of the adjacent depressions. The measurements of the individual depressions being seven inches from back trailing edge to front leading edge with a depth, at the deepest point, of one half inch and a lateral length across of sixteen inches. These specifications result in five inches of uncut surface between each set of adjacent depressions. Therefore, the above specifications would require fifty-two hundred and eighty cuts per mile.

A recent innovation in the specifications for the installation of SNAP depressions requires a skip pattern be incorporated within the series. One example of such a series has eight depressions spaced as detailed above followed by an uncut area equal to the normal placement of four depressions. Such installation affords reasonable coverage of a highway while reducing the expense of installation. Limited access highways and rural roads are likely locations for SNAP depressions to be installed due to the fatigue that a driver experiences during extended driving on such roads.

Various attempts have been made to provide a machine capable of quickly, accurately, consistently and precisely installing SNAP depressions. These attempts have been less efficient than desired. As such, it may be appreciated that there continues to be a need for a machine that can consistently form depressions in a continuous, non pausing, manner having precise placement and precise dimensions. The present invention substantially fulfills these needs.

SUMMARY

In view of the foregoing requirements for a machine to install SNAP depressions, the applicant has devised such a machine. This machine uses a cam member to regulate the raising and lowering of the rotary cutting head. A plurality of camming groups are incorporated on the periphery of the cam member. Each camming group would have a lower surface having a minimum relative height contact position and a raising surface having a maximum relative height contact position. These opposing positions placing the axis line of the cam member at opposing ends of an elevational range of motion. During usage the cam member would be in constant contact or indirect communication with the asphalt surface under treatment. The cam member would rotate based on the passage of the machine over the surface under treatment. The axis line would transfer a raising motion and a lowering motion to the cutting head.

A cam wheel, one example of a cam member, is actually an eccentric wheel being not exactly circular in shape or motion and deviating from circular shape. This definition is based on definitions contained in "Webster's New Twentieth Century Dictionary of the English Language", unabridged, second edition.

The cam wheel, having a plurality of camming groups, causes the cutting head to move downward, and into contact with the surface to begin cutting a depression, and to move upward, and out of contact with the surface to end cutting of the depression. Uniformly spacing of the depressions result from the actual tracking by the cam wheel of the surface under treatment. A resulting transference of the desired pattern to the surface is accurately assured.

One method uses at least one cam wheel and a pivot point. The cam wheel would most likely be positioned in front of the cutting head. This placement affords contact with the surface under treatment without undue concern of contamination by debris caused by the milling operation. The pivot point would be located in front of the cam wheel and the cutting head, between the cam wheel and the cutting head or behind the cam wheel and the cutting head. The pivot point would either be an assembly directly in contact with the surface under treatment or a position attached to the transport vehicle. The cam wheel pivotally causes the raising and lowering of the cutting head into and out of contact with the surface under treatment.

A second method places two identical synchronized cam wheels on the opposite sides of the cutting head. Here they would carry the cutting head chariot style while providing the camming action.

A third method places cam members on the opposing ends of the cutting head in front of and behind the cutting head based on the orientation of the direction of travel of the machine.

A fourth method moves the camming member out of direct contact with the surface under treatment. This method preferable provides rotation of the camming member relative to the passage of the machine over the surface under treatment.

The rotational profile of a cam wheel will have a plurality of camming groups as detailed elsewhere. As also detailed elsewhere the rotational profile may differ from the cam wheels physical periphery. Each camming groups rotational profile will have a maximum radial distance and a minimum radial distance. Both distances are measured from the axis line of the cam wheel to the contact point of the rotational profile with the surface under treatment. Two possible rotational modes exist for cam wheels. One mode places the maximum radial distance position and the minimum radial distance position in contact with the surface under treatment at, or nearly at, the same time during rotation. This facilitates a pivoting from the maximum radial distance position of one camming group to the maximum radial distance position of the following camming group. This orientation provides for a gradual lowering of the axis line as it advances. This is followed by a sudden change in direction upward to be followed by a gradual raising. This is followed by a gradual, smooth, transition into the gradual lowering of the axis line. The second mode is exampled by curved surfaces on the cam wheel, with a rolling through from the maximum radial distance location to the minimum radial distance location. This orientation provides for smooth transition from the lowering to the raising motions as well as from the raising to the lowering motions of the axis line.

The first mode affords a greater range of motion than the second mode due to the bottoming out, with the resulting sudden change in direction. This mode can perform a near plunge cut with very little forward motion of the rotary cutting head while the rotary cutting head is in contact with the surface under treatment. A rotary cutting head having a diameter equal to, or nearly equal to, the resulting depression is required. This mode additionally permits milling through the cut when the pivot point is placed between the camming wheel and the rotary cutting head.

The second mode, while limiting the elevational range of motion, permits milling through the cut while the rotary cutting head advances forward with the machine. A rotary cutting head having a smaller diameter than would otherwise fit the resulting depression is required. Because grinding occurs during a greater distance of the forward motion, a smoother, less jerky, action results.

Incorporation of a skip pattern within the series would be easy to implement. Select camming groups on the periphery of the cam wheel would not transfer a lowering action to the rotary cutting head. Such selective elimination would provide accurate resumptions of the series while eliminating lowering of the rotary cutting head during the passage of this section. A second method of incorporating a skip pattern within the series is to either elevate the cutting head during passage of the skip section or otherwise block the lowering action during such passage.

The specific cam wheel would have two or more camming groups. The rotational profile of the cam wheel will have a circumferential measurement. This measurement will be equal to the number of camming groups multiplied by the longitudinal spacing of the resulting depressions. Based on the specification for installation, including spacing between adjacent depressions and the required depth of the depression, large cam wheels, having many camming groups, are possible. It being recognized that the range of elevation required to provide the proper depth of cut and to provide for clearance of the uncut spacing area between cuts is an important consideration. Placement of the cam wheel between the pivot point and the rotary cutting head will allow usage of large cam wheels having many camming groups.

During a complete revolution the cam wheel may place the entire periphery into contact with the surface under treatment. Such continual contact is not required as disclosed elsewhere. Designs are envisioned, with examples given, which provide intermittent contact with the surface under treatment.

The invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposed of the present invention. It is important, therefore, that the claims be regarded as including such equivalent constructions insofar as they do not depart from the spirit and scope of the present invention.

It is therefore an object of the present invention to provide a machine and method to precisely install SNAP depressions in a consistent and uniform manner.

It is another object of the present invention to provide for the continuous forming of SNAP depressions without requiring pausing the machine during such installation.

It is a further object of the present invention to permit operation of the machine by operators having ordinary skill with such equipment without requiring repetitive precision placement of the machine.

An even further object of the present invention to provide for simple accurate incorporation of skip patterns within the series of installed SNAP depressions.

Yet another object of the present invention is to provide for milling through the depression cuts utilizing the cam wheel regulatory method.

Still yet another object of the present invention is to provide for plunge cuts to be made utilizing the cam wheel regulatory method.

An even further object of the present invention is to provide for various placements of the pivot point to control the elevational range of the rotary cutting head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
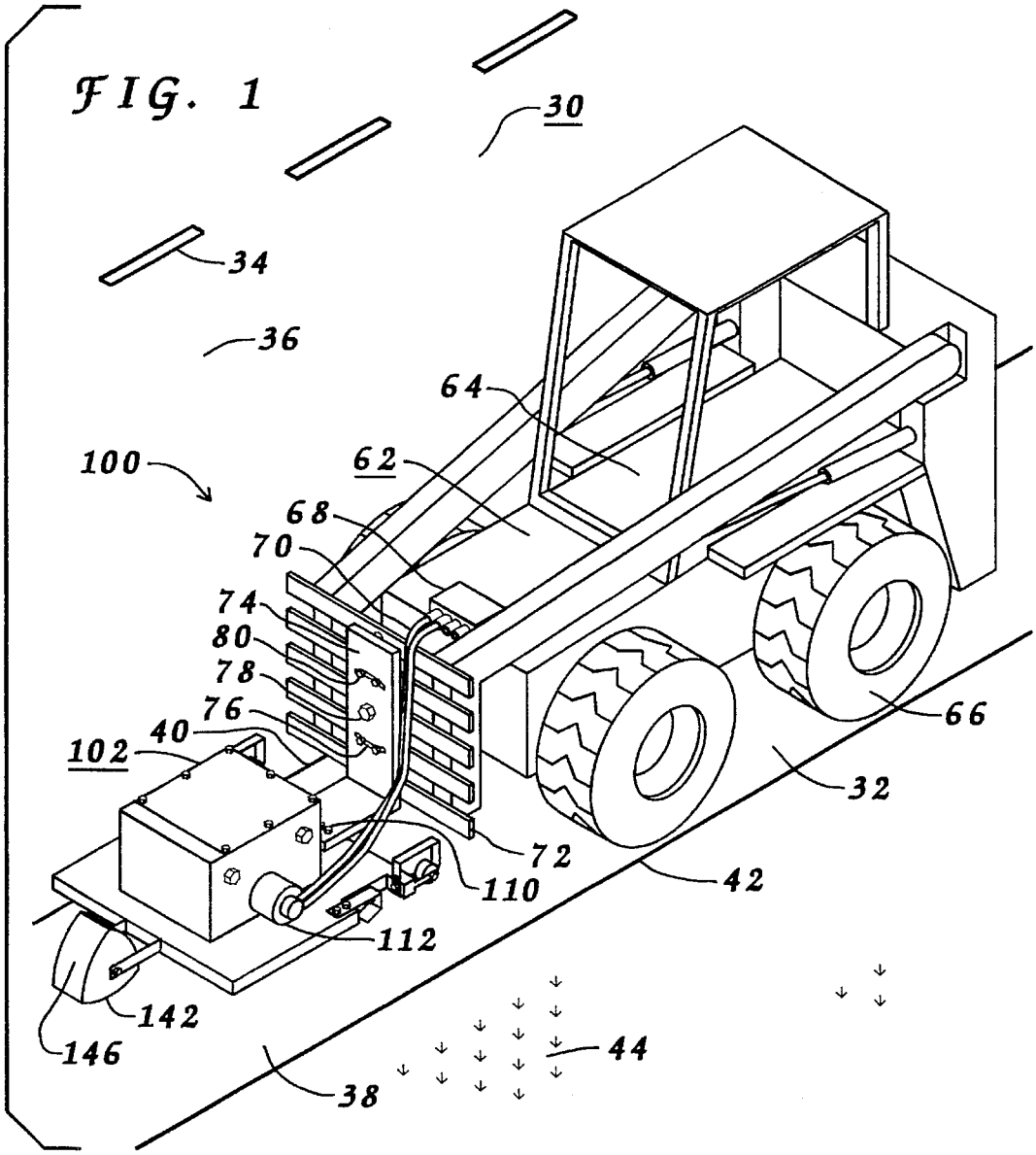
FIG. 1 is a perspective view of a cutting tool attached to a transport vehicle properly positioned on a road.

Referring now to the drawings where like reference numerals refer to like parts throughout the various views, and specifically referring to FIG. 1 through FIG. 4, a roadway 30 is shown formed of asphalt 32 and having center markings 34. Roadway 30 is divided into a driving surface 36 and an extended edge 38 by a side marking line 40. An edge of pavement 42 separates extended edge 38 from a shoulder 44. A skid steer loader 62 having an operator compartment 64 is shown, in FIG. 1 and FIG. 3, positioned on roadway 30 awaiting commencing of a cutting procedure. Skid steer loader 62 having wheels 66 and being self propelled and having power transfer means, in the form of hydraulic transfer, is well suited to practice the invention. Many different machines are equally well suited for such practice and are well known in the art. Hydraulic connection box 68 provides hydraulic pressure utilizing hydraulic hose 70. Connecting plate 72 is attached to skid steer loader 62 and is adaptable to receive an attachment plate 74 having slots 76. Attachment plate 74 is connected to connecting plate 72 utilizing bolt 78 and bolts 80 through slots 76. Thus attachment plate 74 is tiltable relative to connecting plate 72.

Figure 4:
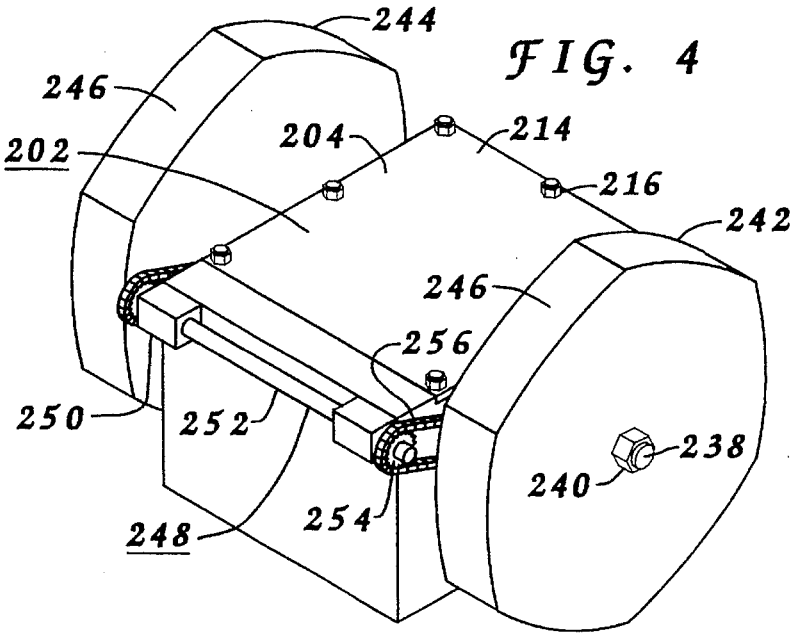
FIG. 4 is an enlarged perspective view of the cutting tool illustrated in FIG. 3.
Figure 5:
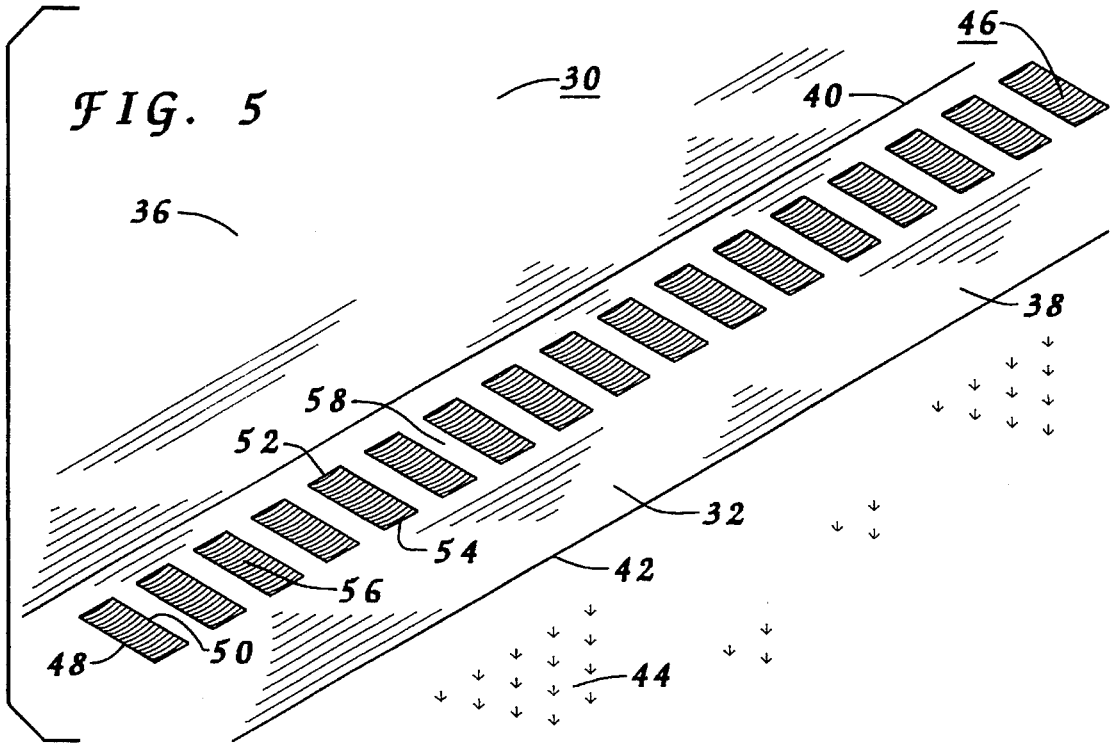
FIG. 5 is a perspective view of installed SNAP depressions in the roadway depicted in FIG. 1 and FIG. 3.

Many different configurations exist for SNAP depressions, with an example set shown in FIG. 5, which are used only as examples, and not limitations. The example specifications are recited below, with the understanding that the illustrative machines depicted in FIG. 1 through FIG. 4 are adaptable to install the example series shown in FIG. 5. Throughout the views various axles are identified and it is understood that each axle is an axis line.

Figure 2:
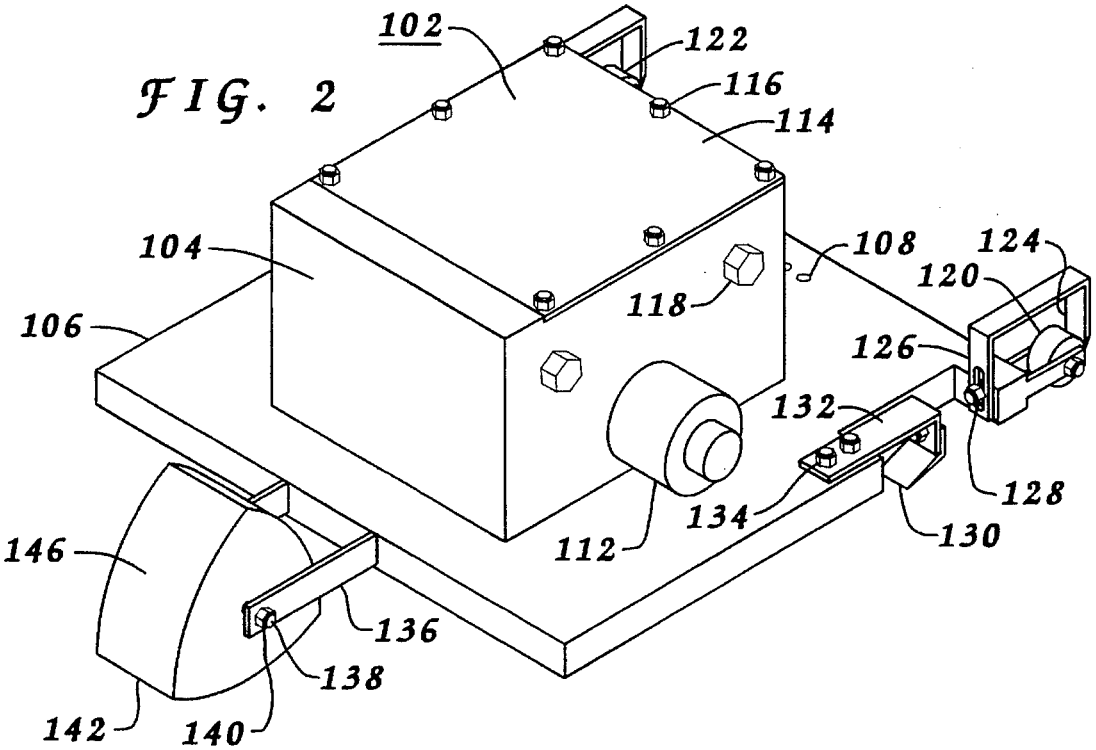
FIG. 2 is an enlarged perspective view of the cutting tool illustrated in FIG. 1.

FIG. 1 and FIG. 2 show a machine 100 comprising a cutting tool 102 having a cutting head enclosure 104 secured to a support plate 106. Contained within cutting head enclosure 104 is a rotary cutting head, not shown, adaptable to mill asphalt. Support plate 106 is secured to attachment plate 74 utilizing assembly attachment holes 108, shown in FIG. 2, and bolts 110, shown in FIG. 1. Rotary cutting head is powered to rotate by a rotation generation device 112 which receives power via hydraulic hoses 70. Entry plate 114 is secured to cutting head enclosure 104 utilizing entry plate nuts 116. Access for adjustment and routine maintenance is facilitated by removing entry plate 114. Elevational adjustment of rotary cutting head relative to support plate 106 is provided for by cutting head adjustment apparatus 118 which affords consistent depth of cut along the lateral length of the resulting cuts.

A first support wheel 120 and a second support wheel 122 are attached to support plate 106 in opposing rear corners. First support wheel 120 and second support wheel 122 are in constant contact with the surface under treatment during usage. A wheel cleaning member 124 is attached to support plate 106 utilizing a variable attachment member 126 and a connecting bolt 128. Wheel cleaning member 124 prevents accumulation of debris on the respective support wheel. A road clearing member 130 is attached to support plate 106 utilizing a connection member 132 and connection bolt 134, in the path of each support wheel, 120 and 122. Road clearing member 130 removes debris from the path of each support wheel, 120 and 122, to ensure accurate tracking of the surface under treatment. First support wheel 120 and second support wheel 122 provide a pivotal point for cutting tool 102 to be angularly pivoted upward and downward from. While the pivot point has been disclosed as being in direct communication with the surface under treatment, placement of the pivot point on the transport vehicle is equally possible.

Attached to the front of support plate 106 is a support member 136 which has attached thereto a support shaft 138 utilizing bolts 140. Mounted on support shaft 138 is a cam wheel 142 having three camming groups 146, as detailed elsewhere. Support shaft 138 is the axle for cam wheel 142 and therefore is an axis line. Cam wheel 142 will be in constant contact with the surface under treatment during usage, and will rotate relative to the passage of machine 100 over the surface under treatment. As each of the three camming groups 146 pass over the surface under treatment, support shaft 138 will advance with the passage of the machine and will move upward and downward depending upon the respective elevation corresponding to the surface under treatment. This raising and lowering of support shaft 138 will cause a pivotal elevation of cutting tool 102 relative to the pivot point formed by first support wheel 120 and second support wheel 122. As disclosed elsewhere, this will result in the rotary cutting head being brought into contact with the surface under treatment and taken out of contact with the surface under treatment in a repetitive manner to form the desired SNAP depressions.

Figure 3:
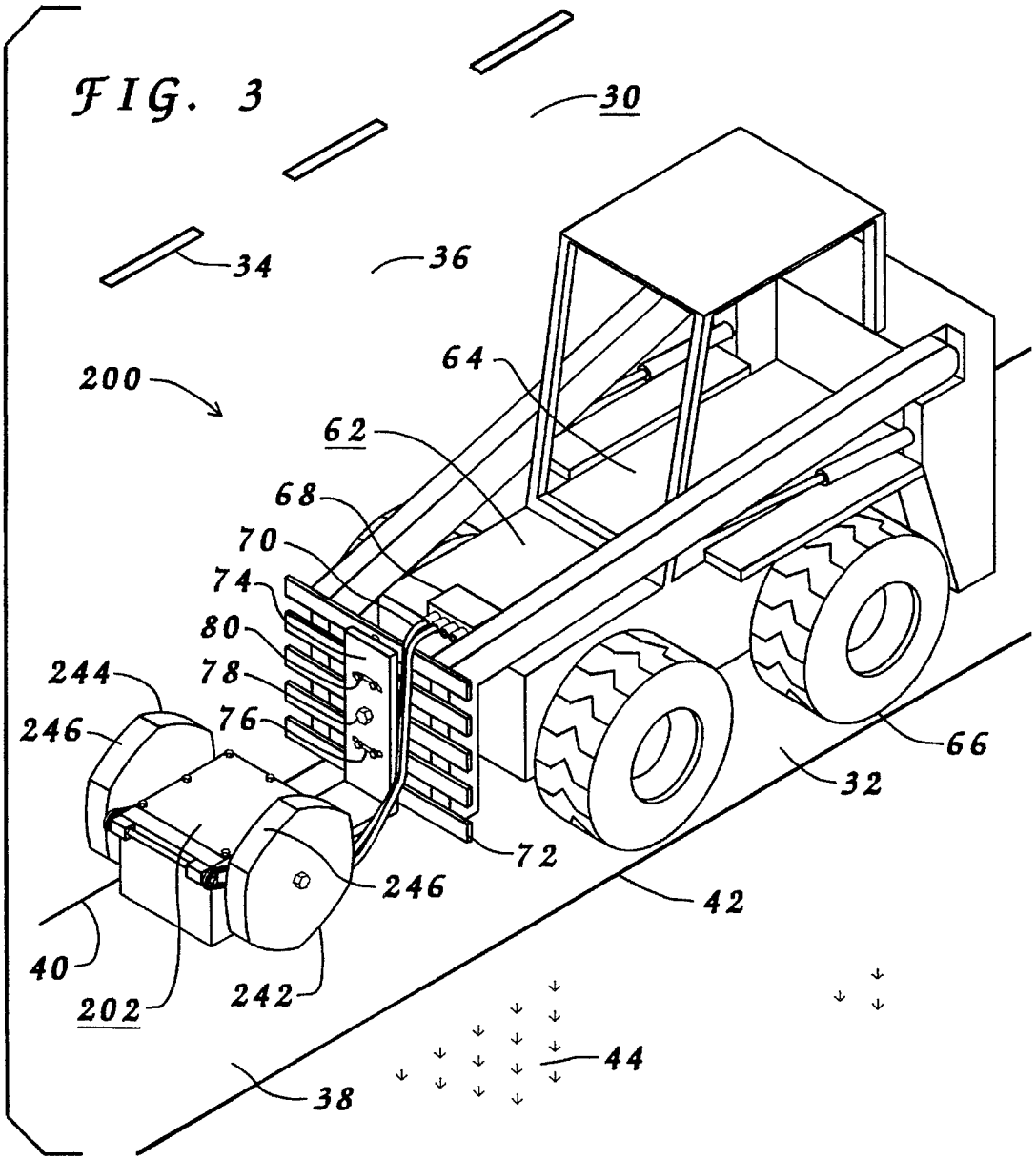
FIG. 3 is a perspective view of a cutting tool attached to a transport vehicle properly positioned on a road.

FIG. 3 and FIG. 4 show a machine 200 comprising a cutting tool 202 containing a rotary cutting head, not shown. Rotation generation for the rotary cutting head is similar to the disclosure for FIG. 1 and FIG. 2. A cutting head enclosure 204, having an entry plate 214 secured utilizing entry plate nuts 216, has attached on opposing lateral ends a first cam wheel 242 and a second cam wheel 244. First cam wheel 242 and second cam wheel 244 each have six matching camming groups 246. First cam wheel 242 and second cam wheel 244 are synchronized to rotate in a matching manner utilizing a synchronizing member 248. Synchronizing member 248 comprises shaft housings 250 with a connection shaft 252 attached thereto. Gears 254 are attached to the opposing ends of connection shaft 252 with engagement of chains 256. Each chain 256 extends to a gear attached to the inner side of shaft 238, not shown. Each shaft 238 is secured to cutting head enclosure 204 by any conventional method known in the art. First cam wheel 242 and second cam wheel 244 are each attached to their respective shaft 238 and rotatably secured thereto by a bolt 240.

First cam wheel 242 and second cam wheel 244 rotate in a corresponding manner as they transverse the surface under treatment. During such passage longitudinally along the surface under treatment, cutting head enclosure 204 will be raised and lowered by the camming action of camming groups 246 of the synchronized first cam wheel 242 and second cam wheel 244. This raising and lowering action will bring the rotary cutting head into contact and out of contact with the surface under treatment repetitively to form the desired series of SNAP depressions.

Figure 6:
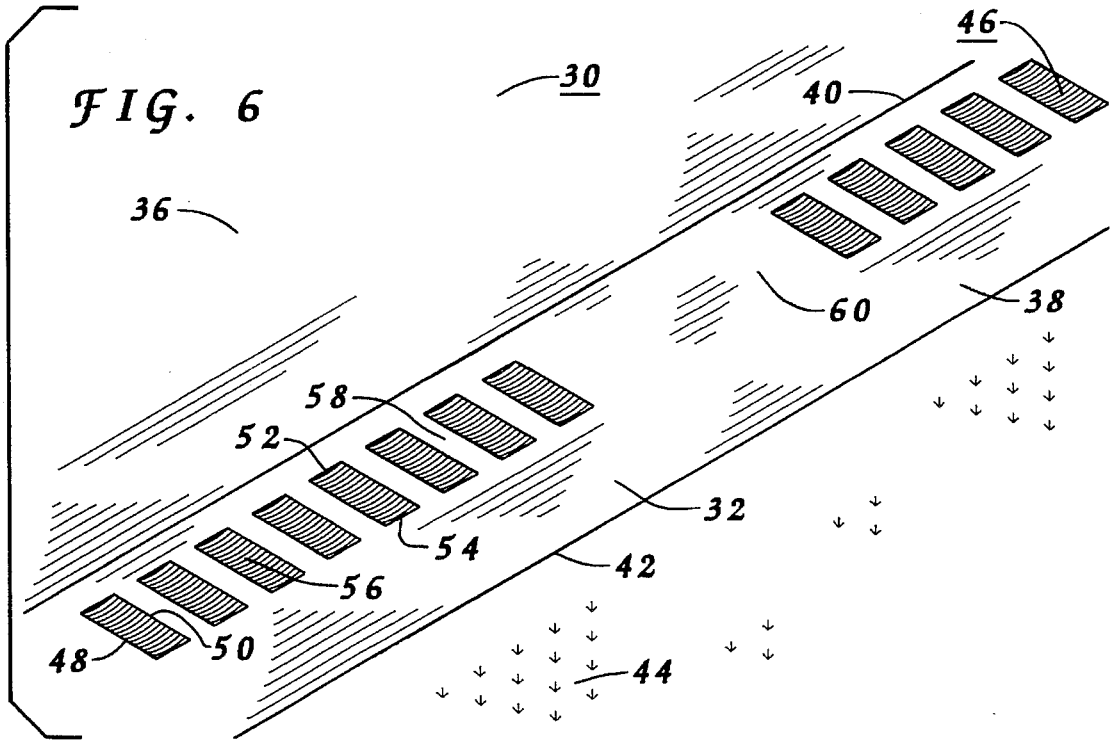
FIG. 6 is a perspective view of installed SNAP depressions, having a skip pattern incorporated therein, in the roadway depicted in FIG. 1 and FIG. 3.

Various specifications are possible for SNAP depressions. Two such examples, given only for illustrative purposes, are depicted in FIG. 5 and FIG. 6. A roadway 30, formed of asphalt 32, is separated into two distinct areas by a side marking line 40. These two areas are a driving surface 36 and an extended edge 38. Roadway 30 is separated from a shoulder 44 by an edge of pavement 42.

In FIG. 5 extended edge 38 has installed therein a series of seventeen depressions 46 while FIG. 6 has installed therein thirteen depressions 46. Each depression 46 has a first edge 48 and a second edge 50. These edges are relatively perpendicular to edge of pavement 42 and each is transitional, gradually sloping into depression 46. Each depression 46 further has a first side 52 and a second side 54. These sides are relatively parallel to edge of pavement 42. Each depression 46 has a center of cut 56 which extends from first side 52 to second side 54 and is of a relatively even depth measured from the plane formed by the surrounding asphalt 32. The shading depicted within each depression 46 is for illustrative purposes to depict the curved shape. A separating strip 58 separates each adjacent set of depressions 46. Separating strip 58 is an area of uncut asphalt 32.

The example SNAP depressions have a length, measured from second edge 50 to first edge 48 of approximately seven inches, a width, measured from first side 52 to second side 54 of approximately sixteen inches and a depth of approximately one half inch. Each adjacent set of depressions, with the exception of skip pattern 60 shown in FIG. 6, are separated by approximately five inches of uncut asphalt 32. Therefore each adjacent set of depressions 46 in a continuous series are spaced apart, measured from center to center, approximately twelve inches. Therefore, the continuous pattern illustrated in FIG. 5 would require approximately fifty two hundred and eighty cuts per mile of installation.

FIG. 6 depicts depressions 46 with the addition of a skip pattern 60. Rather than continuous installation, a predetermined group of cuts are eliminated during installation. The example illustrated produces eight installations followed by the elimination of installation of four in a repetitive loop. Therefore, the skip pattern illustrated in FIG. 6 would require approximately thirty five hundred and twenty cuts per mile of installation.

Throughout the various illustrations various cam wheel tracking lines and various rotary cutting head tracking lines are depicted. These various lines are imaginary and illustrated to explain various physical relationships of movement of the various components. No representation of any physical structure is intended.

FIG. 7*a* through FIG. 7*c*, FIG. 8*a* through FIG. 8*c*, FIG. 9*a* through FIG. 9*c* and FIG. 10*a* through FIG. 10*c* illustrate several of the means to transfer the camming roll of cam wheel 304 having an axle 310 to the various rotary cutting heads. The camming roll of cam wheel 304, identified as cam wheel tracking line 308, is transferred to the various rotary cutting heads, and identified as various rotary cutting head tracking lines. The cam wheel, the various rotary cutting heads as well as the wheel assembly which contains the pivotal point are depicted as graphical representations utilized to illustrate several possible orientations. Each of the four series begin with four-previously installed depressions 302 and end following the installation of a fifth depression 302. A direction of travel is represented as well as direction of rotation of cam wheel 304 and the various rotary cutting heads.

Cam wheel tracking line 308 is depicted as would result from rotation through three camming groups 306 within this series. Cam wheel 304 rotates based on passage along asphalt surface 300 and produce a cam wheel tracking line 308. Cam wheel tracking line 308 is shown in all the views as produced by rotation through two camming groups 306. The first view within each of the series positions cam wheel 304 in the middle of cam wheel tracking line 308 following completion of passage through one camming group 306. The orientation of FIG. 9*a* through FIG. 9*c* produces a reverse transference of the motion of cam wheel tracking line 308 to rotary cutting head 338.

Each camming group 306 contains a maximum radius measurement position 312 and a minimum radius measurement position 314. When maximum radius measurement position 312 is in contact with asphalt surface 300 and directly below axle 310 of cam wheel 304, axle 310 is at its maximum elevational range possible to asphalt surface 300. When minimum radius measurement position 314 is in contact with asphalt surface 300 and directly below axle 310 of cam wheel 304, axle 310 is at its minimum elevational range possible to asphalt surface 300. The second view and third view within each series placing cam wheel 304 at the respective location along cam wheel tracking line 308 during rotation through camming group 306. The various cutting heads are preferably power driven as previously disclosed. The relational transference of motion from cam wheel tracking line 308 to the respective rotary cutting heads are detailed below.

Figure 7A:
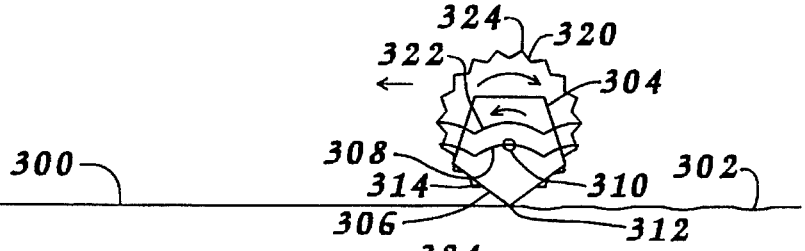
FIG. 7*a* through FIG. 7*c* are plan views of a cam wheel and a rotary cutting head illustrating several positions during a cutting procedure.
Figure 7B:
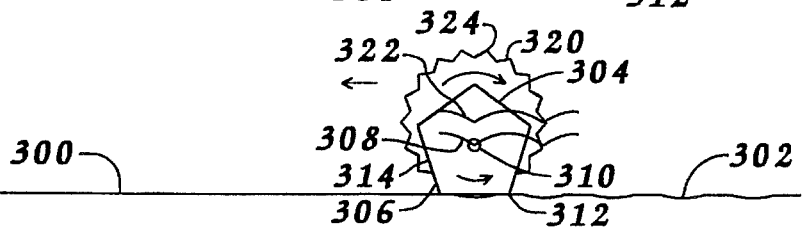
Figure 7C:
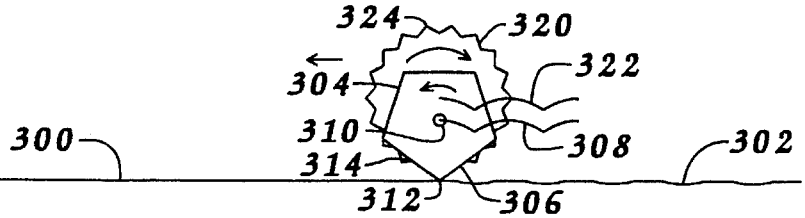

FIG. 7*a* through FIG. 7*c* show cam wheel 304 directly transferring motion to rotary cutting head 320 during the camming roll. An axle, not shown, of rotary cutting head 320 is longitudinally aligned with axle 310 of cam wheel 304, although the elevational relationship may vary. Rotary cutting head tracking line 322 depicts the movement of rotary cutting head 320. Rotary cutting head 320 contains cutting teeth 324 which cause formation of depression 302 when rotary cutting head 320 comes into contact with asphalt surface 300. A near plunge cut, as shown, is possible or, utilizing a different tracking line profile such as exampled in FIG. 11*a*, FIG. 12*a*, FIG. 13*a* or FIG. 14*a*, longitudinal grinding through of each depression is possible.

Figure 8A:
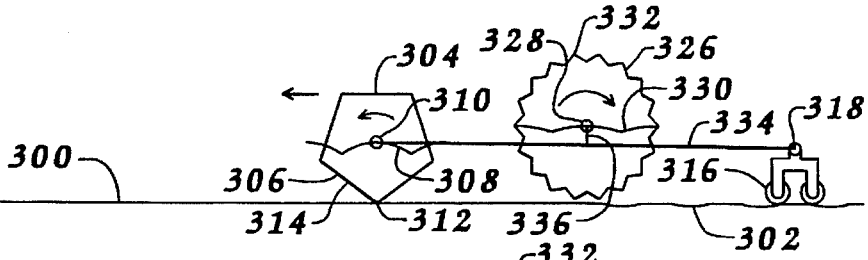
FIG. 8*a* through FIG. 8*c* are plan views of a cam wheel and a rotary cutting head illustrating several positions during a cutting procedure.
Figure 8B:
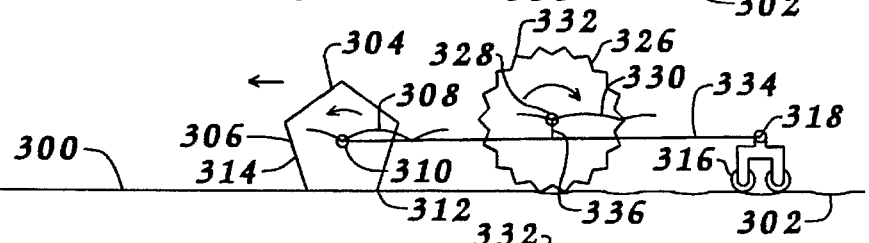
Figure 8C:
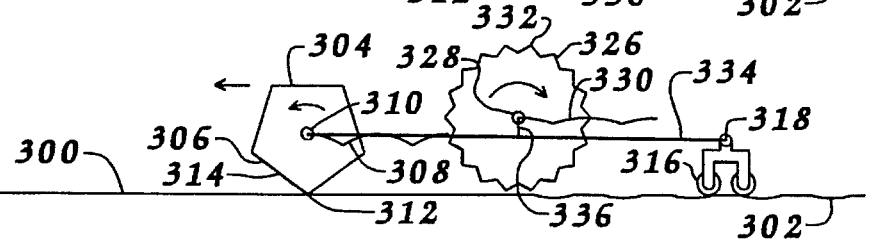

FIG. 8*a* through FIG. 8*c* show cam wheel 304 having axle 310 transferring motion to rotary cutting head 326 during the camming roll. A wheel 316 is shown in direct contact with asphalt surface 300. A pivot point 318 is in direct communication with wheel 316 and therefore remains a relatively consistent elevation to asphalt surface 300. Wheels 316 would remain outside of depressions 302 formed in asphalt surface 300 and therefore would consistently track asphalt surface 300. Cam wheel 304 contains an axle 310 which forms a cam wheel tracking line 308 as it rolls along asphalt surface 300 in the direction of travel shown. The camming roll of cam wheel 304 as it passes through each camming group 306 causes the repetitive elevation motion of axle 310. A pivot line 334 connects pivot point 318 and axle 310 of cam wheel 304. Rotary cutting head 326 has an axle 328 which is connected to pivot line 318 utilizing a support extension 336. The camming roll of cam wheel 304 causes pivot line 334 to transfer to rotary cutting head 326 a proportional amount of the elevational motion represented by cam wheel tracking line 308 of cam wheel 304. This transference is represented as rotary cutting head tracking line 330. This proportional amount depends primarily upon the relationship of axle 328 of rotary cutting head 326 to both axle 310 of cam wheel 304 and pivot point 318. When axle 328 of rotary cutting head 326 is midpoint between these two points, approximately one half of the elevational range of cam wheel tracking line 308 is transferred. When axle 328 of rotary cutting head 326 is closer to axle 310 of cam wheel 304 a greater proportion of the elevational range of cam wheel tracking line 308 is transferred. When axle 328 of rotary cutting head 326 is closer to pivot point 318 a lesser proportion of the elevational range of cam wheel tracking line 308 is transferred.

Figure 9A:
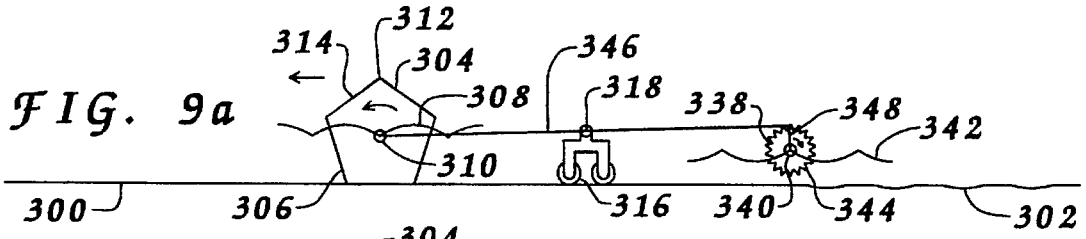
FIG. 9*a* through FIG. 9*c* are plan views of a cam wheel and a rotary cutting head illustrating several positions during a cutting procedure.
Figure 9B:
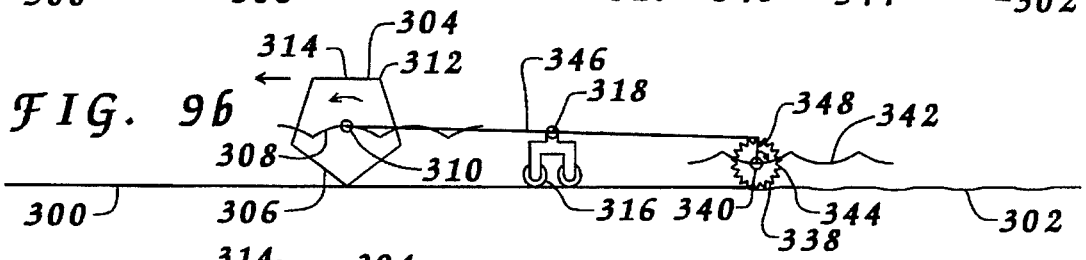
Figure 9C:
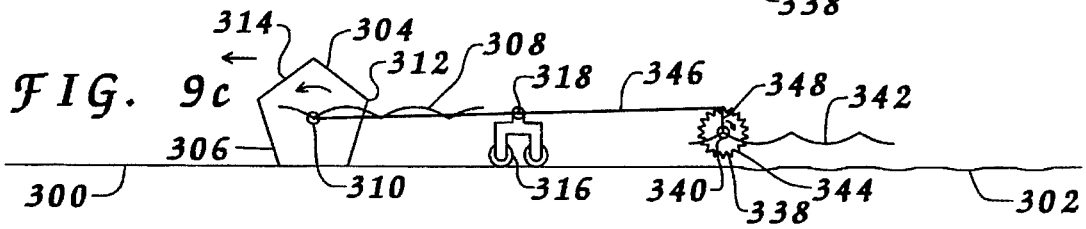

FIG. 9*a* through FIG. 9*c* show cam wheel 304 having axle 310 transferring a reversal motion to rotary cutting head 338 during the camming roll. Wheel 316 is shown in direct contact with asphalt surface 300. Pivot point 318 is in direct communication with wheel 316 and therefore remains a relatively consistent elevation to asphalt surface 300. Cam wheel 304 contains axle 310 which forms cam wheel tracking line 308 as it rolls along asphalt surface 300 in the direction of travel shown. The camming roll of cam wheel 304 as it passes through each camming group 306 causes the repetitive elevation motion of axle 310. A pivot line 346 connects pivot point 318 and axle 310 of cam wheel 304. Rotary cutting head 338 has an axle 340 which is connected to pivot line 346 utilizing a support extension 348. The camming roll of cam wheel 304 causes pivot line 346 to transfer to rotary cutting head 338 a reversed proportional amount of the elevational motion represented by cam wheel tracking line 308 of cam wheel 304. This transference is represented as rotary cutting head tracking line 342. This reverse proportional amount depends primarily upon the relationship of pivot point 318 to both axle 310 of cam wheel 304 and axle 340 of rotary cutting head 338. When pivot point 318 is midpoint between these two points, approximately all of the elevational range of cam wheel tracking line 308 is transferred. When pivot point 318 is closer to axle 310 of cam wheel 304 a greater proportion of the elevational range of cam wheel tracking line 308 is transferred. When pivot point 318 is closer to axle 340 of rotary cutting head 338 a lesser proportion of the elevational range of cam wheel tracking line 308 is transferred.

Figure 10A:
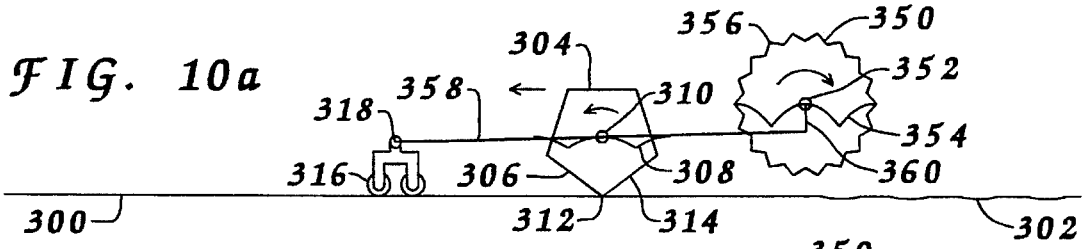
FIG. 10*a* through FIG. 10*c* are plan views of a cam wheel and a rotary cutting head illustrating several positions during a cutting procedure.
Figure 10B:
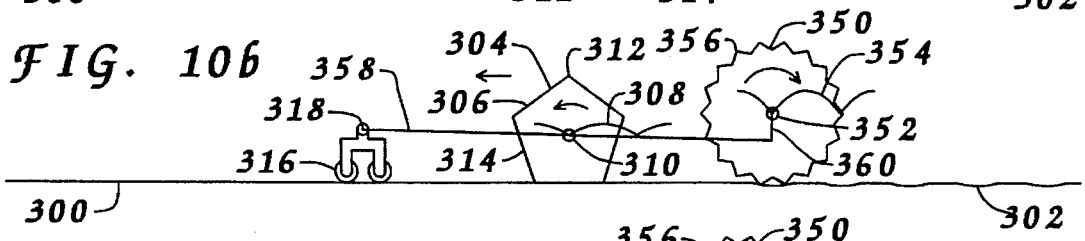
Figure 10C:
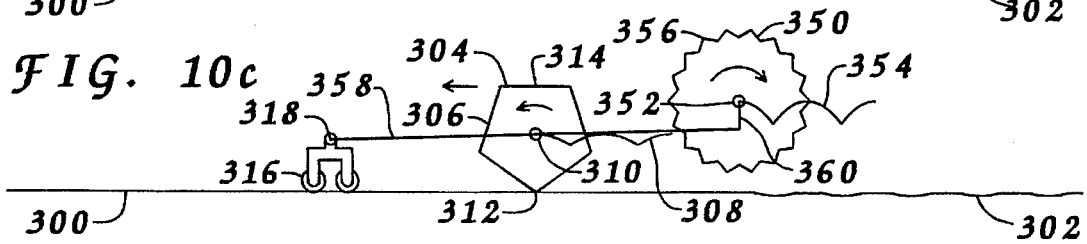

FIG. 10*a* through FIG. 10*c* show cam wheel 304 having axle 310 transferring motion to rotary cutting head 350 during the camming roll. Wheel 316 is shown in direct contact with asphalt surface 300. Pivot point 318 is in direct communication with wheel 316 and therefore remains a relatively consistent elevation to asphalt surface 300. Cam wheel 304 contains axle 310 which forms cam wheel tracking line 308 as it rolls along asphalt surface 300 in the direction of travel shown. The camming roll of cam wheel 304 as it passes through each camming group 306 causes the repetitive elevation motion of axle 310. A pivot line 358 connects pivot point 318 to axle 310 of cam wheel 304 and extends beyond cam wheel 304. Rotary cutting head 350 has an axle 352 which is connected to pivot line 358 utilizing a support extension 360. The camming roll of cam wheel 304 causes pivot line 358 to transfer to rotary cutting head 350 an exaggerated proportional amount of the elevational motion represented by cam wheel tracking line 308 of cam wheel 304. This transference is represented as rotary cutting head tracking line 354. This exaggerated proportional amount depends primarily upon the relationship of axle 310 of cam wheel 304 to both pivot point 318 and axle 352 of rotary cutting head 350. When axle 310 of cam wheel 304 is midpoint between these two points, approximately twice the elevational range of cam wheel tracking line 308 is transferred. When axle 310 of cam wheel 304 is closer to pivot point 318 a greater exaggeration of the elevational range of cam wheel tracking line 308 is transferred. When axle 310 of cam wheel 304 is closer to axle 352 of rotary cutting head 350 a lesser exaggeration of the elevational range of cam wheel tracking line 308 is transferred.

FIG. 11*a* through FIG. 15*g*, FIG.17*a* through FIG. 17*g* and FIG. 19*a* through FIG. 20*g* depict eight examples of cam wheels, their respective rotation through their respective camming group and their resulting respective cam wheel tracking lines. Specific example dimensions are given only for illustration. Each of the eight series presents longitudinal movement through one camming group with a direction of travel indicated. Each of the respective camming groups has a circumferential measurement of twelve inches matching the desired spacing of the example SNAP depression series. Therefore twelve inches of longitudinal movement is depicted through each of the series. Each of the respective cam wheel tracking lines is depicted as completing the final camming group of the respective cam wheel. Therefore the respective cam wheel tracking lines are depicted in the final illustration of each series as would result from one complete revolution of the respective cam wheel. The above mentioned eight cam wheels are shown relatively proportionally depicted. No other relative proportional relationship exists for any other cam wheels illustrated in the drawings. Construction of the individual cam wheels would be by any of the conventional construction techniques known in the art. A specific example is given below to arrive at the sizing for the cam wheel depicted in FIG. 12*a*. Anyone with ordinary skill in the art will be capable of arriving at specific sizing of the other cam wheels illustrated as well as any of the many other sizes and shapes of possible cam wheels for specific configurations of SNAP depressions.

Figure 11A:
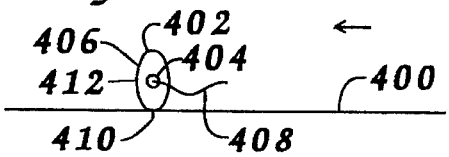
FIG. 11*a* through FIG. 11*g* are plan views of a cam wheel having two camming groups illustrating the motion of the axis line during rotation.
Figure 11B:
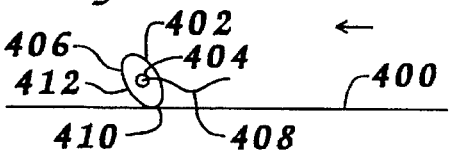
Figure 11C:
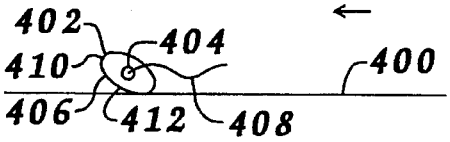
Figure 11D:
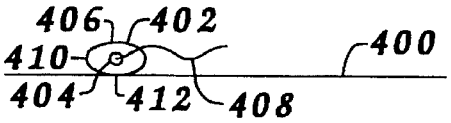
Figure 11E:
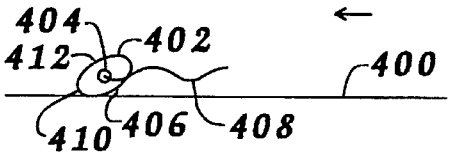
Figure 11F:
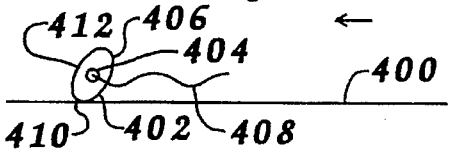
Figure 11G:
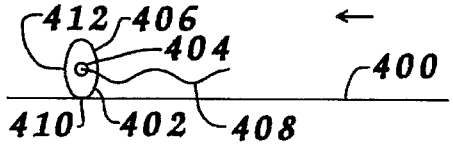

FIG. 11*a* through FIG. 11*g* depict the camming roll of a cam wheel 402 through one camming group 406. Cam wheel 402, having an axle 404, creates a cam wheel tracking line 408 during such motion along surface 400. Cam wheel 402 is oval in shape and contains two camming groups 406. Camming group 406 contains a minimum radius measurement position 412 and a maximum radius measurement position 410 with both measurements made from axle 404. FIG. 11*a* and FIG. 11*g* place maximum radius measurement positions 410 in contact with surface 400 while FIG. 11*d* places minimum radius measurement position 412 in contact with surface 400.

Figure 12A:
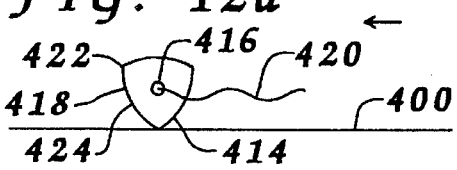
FIG. 12*a* through FIG. 12*g* are plan views of a cam wheel having three camming groups illustrating the motion of the axis line during rotation.
Figure 12B:
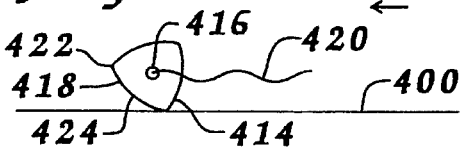
Figure 12C:
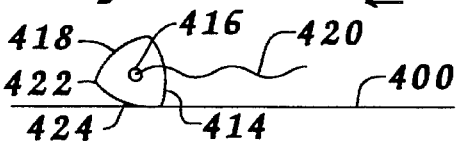
Figure 12D:
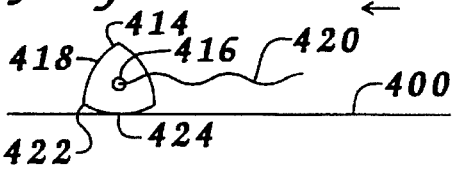
Figure 12E:
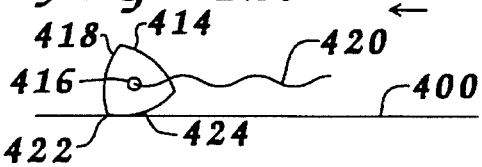
Figure 12F:
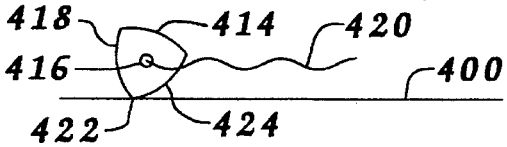
Figure 12G:
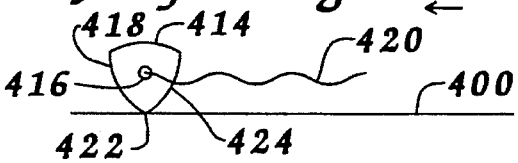

FIG. 12*a* through FIG. 12*g* depict the camming roll of a cam wheel 414 through one camming group 418. Cam wheel 414, having an axle 416, creates a cam wheel tracking line 420 during such motion along surface 400. Cam wheel 414 contains three camming groups 418. Camming group 418 contains a minimum radius measurement position 424 and a maximum radius measurement position 422 with both measurements made from axle 416. FIG. 12*a* and FIG. 12*g* place maximum radius measurement positions 422 in contact with surface 400 while FIG. 12*d* places minimum radius measurement position 424 in contact with surface 400. Cam wheel 414 is formed of three camming groups 418 each having a circumferential measurement of twelve inches. A gradual roll through is desired in this example so a pipe having twice the circumference of the resulting cam wheel is used. Therefore, for this example, a sixty degrees span of a pipe having an approximate twenty two and nine tenths inch diameter is used. Construction of the actual cam wheel is performed by any commonly known method such as welding. An alternative method is to begin with an existing pipe having a diameter closely matching a desired resultant shape, in this example twice the desired circumference divided by pi, or about 3.14159265. From this pipe simple calculations based on a first determination of the circumference of the pipe followed by division of the desired spacing of the SNAP depressions by the circumference. This calculation returns a percentage which is then multiplied by 360, the total number of degrees in the pipe, to return a number of degrees for each of the desired sections. These sections are removed and the cam wheel is constructed as mentioned above with each section becoming a camming group.

Figure 13A:
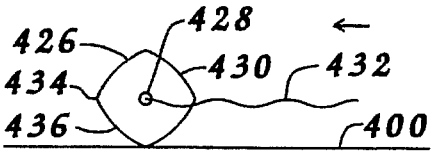
FIG. 13*a* through FIG. 13*g* are plan views of a cam wheel having four camming groups illustrating the motion of the axis line during rotation.
Figure 13B:
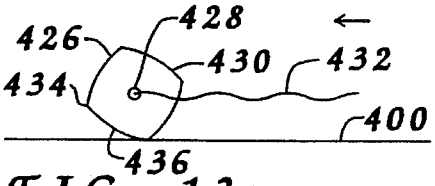
Figure 13C:
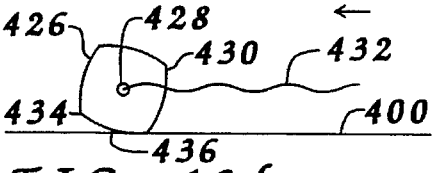
Figure 13D:
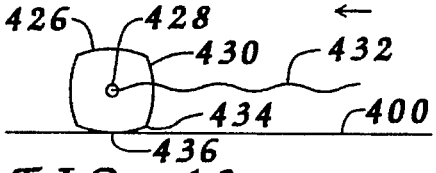
Figure 13E:
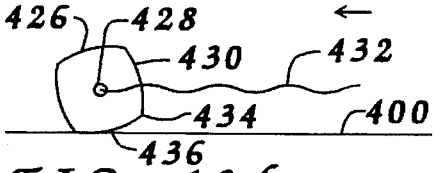
Figure 13F:
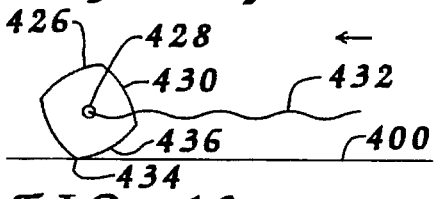
Figure 13G:
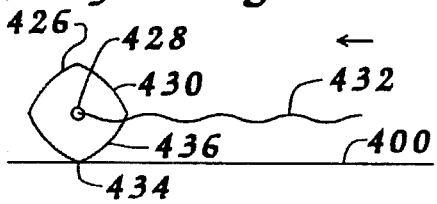

FIG. 13*a* through FIG. 13*g* depict the camming roll of a cam wheel 426 through one camming group 430. Cam wheel 426, having an axle 428, creates a cam wheel tracking line 432 during such motion along surface 400. Cam wheel 426 contains four camming groups 430. Camming group 430 contains a minimum radius measurement position 436 and a maximum radius measurement position 434 with both measurements made from axle 428. FIG. 13*a* and FIG. 13*g* place maximum radius measurement positions 434 in contact with surface 400 while FIG. 13*d* places minimum radius measurement position 436 in contact with surface 400.

Figure 14A:
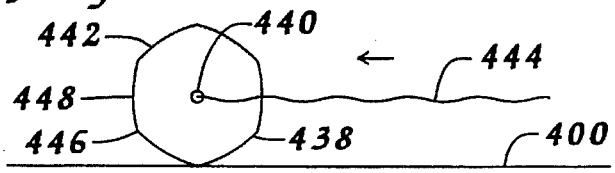
FIG. 14*a* through FIG. 14*g* are plan views of a cam wheel having six camming groups illustrating the motion of the axis line during rotation.
Figure 14B:
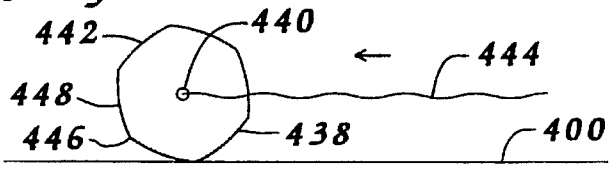
Figure 14C:
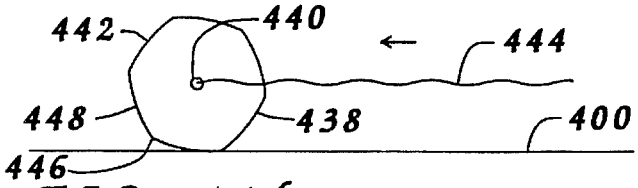
Figure 14D:
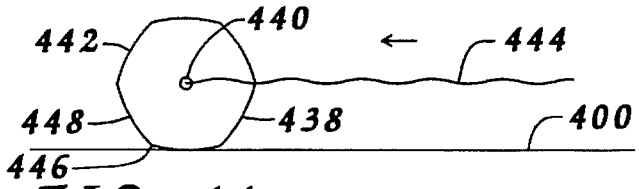
Figure 14E:
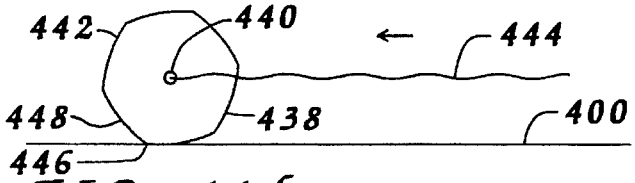
Figure 14F:
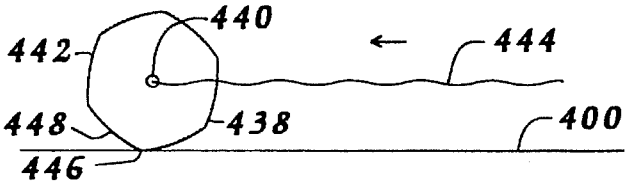
Figure 14G:
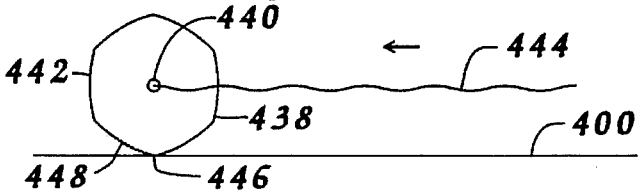
Figure 15A:
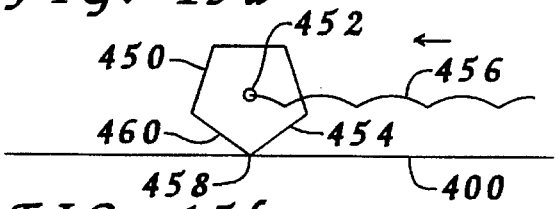
FIG. 15*a* through FIG. 15*g* are plan views of a cam wheel having five camming groups illustrating the motion of the axis line during rotation.
Figure 16A:
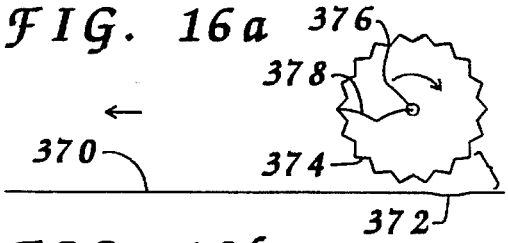
FIG. 16*a* through FIG. 16*g* are plan views of a rotary cutting head illustrating a cutting procedure.
Figure 15B:
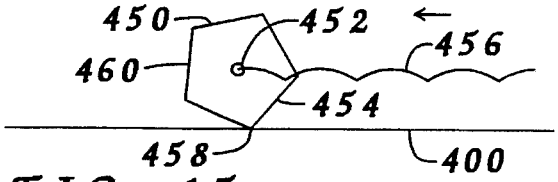
Figure 16B:
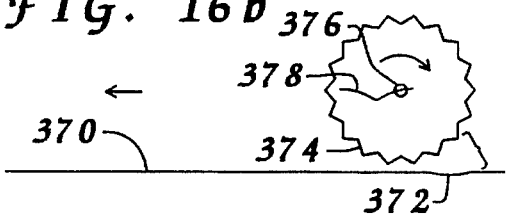
Figure 15C:
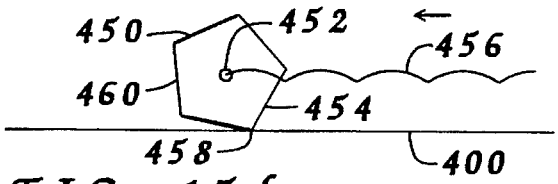
Figure 16C:
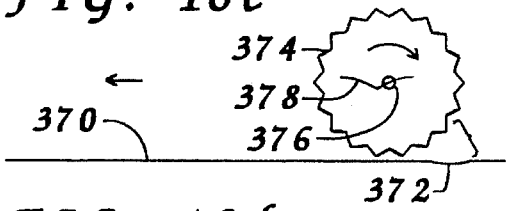
Figure 15D:
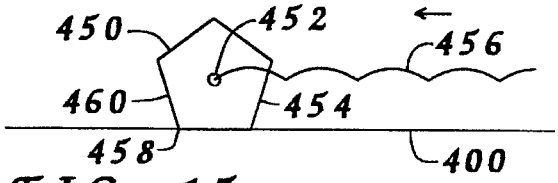
Figure 16D:
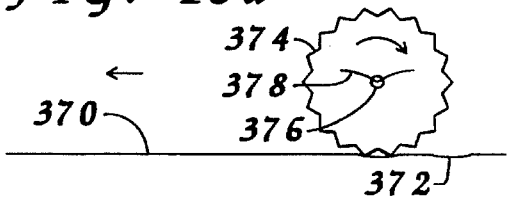
Figure 15E:
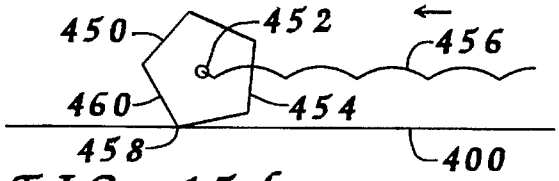
Figure 16E:
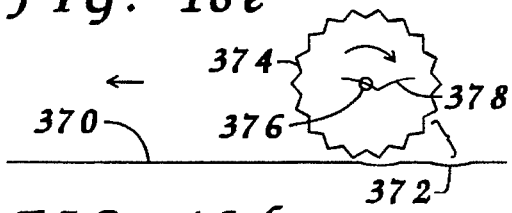
Figure 15F:
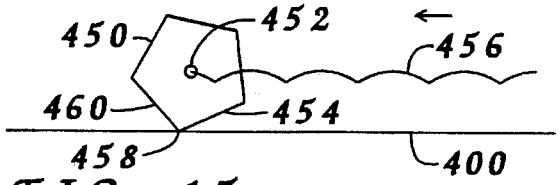
Figure 16F:
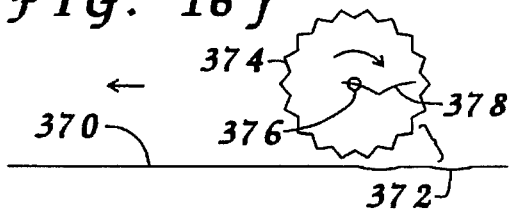
Figure 15G:
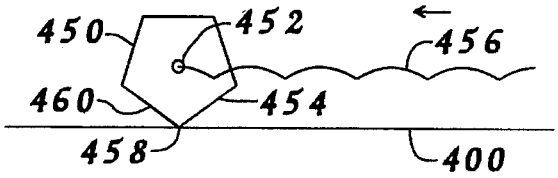
Figure 16G:
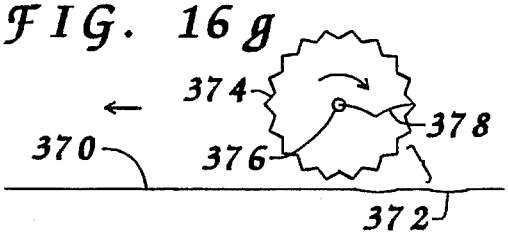

FIG. 14*a* through FIG. 14*g* depict the camming roll of a cam wheel 438 through one camming group 442. Cam wheel 438, having an axle 440, creates a cam wheel tracking line 444 during such motion along surface 400. Cam wheel 438 contains six camming groups 442. Camming group 442 contains a minimum radius measurement position 448 and a maximum radius measurement position 446 with both measurements made from axle 440. FIG. 14*a* and FIG. 14*g* place maximum radius measurement positions 446 in contact with surface 400 while FIG. 14*d* places minimum radius measurement position 448 in contact with surface 400.

FIG. 15*a* through FIG. 15*g* depict the camming roll of a cam wheel 450 through one camming group 454. Cam wheel 450, having an axle 452, creates a cam wheel tracking line 456 during such motion along surface 400. Cam wheel 450 contains five camming groups 454. Camming group 454 contains a minimum radius measurement position 460 and a maximum radius measurement position 458 with both measurements made from axle 452. All of the views within the series place maximum radius measurement positions 458 in contact with surface 400 while FIG. 15*d* places minimum radius measurement position 460 in contact with surface 400 simultaneously with maximum radius measurement position 458. This pivotally moving from consecutive maximum radius measurement positions 458 causes a sudden transition within cam wheel tracking line 456 from a downward movement to an upward movement.

FIG. 16*a* through FIG. 16*g* illustrate the direct transference of cam wheel tracking line 456 shown in FIG. 15*a* through FIG. 15*g* to a rotary cutting head tracking line 378. An axle 376 of rotary cutting head 374 is controlled by cam wheel tracking line 456 of FIG. 15*a* through FIG. 15*g* as disclosed elsewhere. A direction of travel is indicated as well as rotational direction of rotary cutting head 374. A depression 372 is shown preinstalled with a second depression 372 being installed during completion of the series. Due to the sudden transition from downward movement to upward movement a plunge cut, or near plunge cut, is performed. Very little longitudinal movement of rotary cutting head 374 occurs while in contact with asphalt surface 370.

Figure 17A:
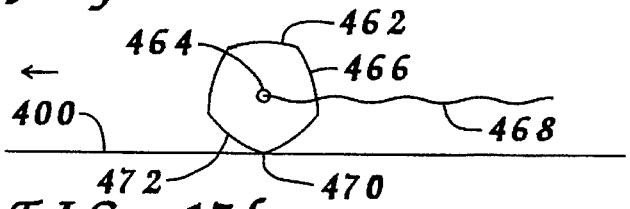
FIG. 17*a* through FIG. 17*g* are plan views of a cam wheel having five camming groups illustrating the motion of the axis line during rotation.
Figure 17B:
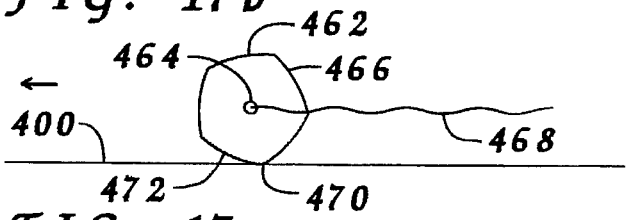
Figure 17C:
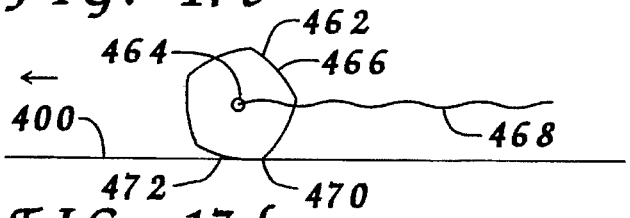
Figure 17D:
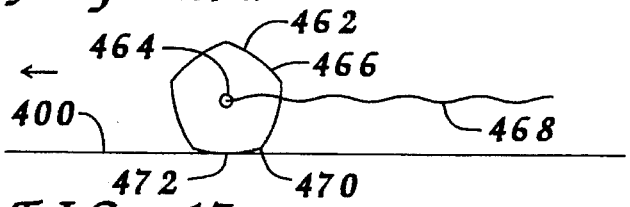
Figure 17E:
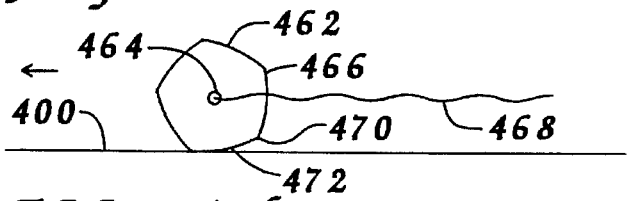
Figure 17F:
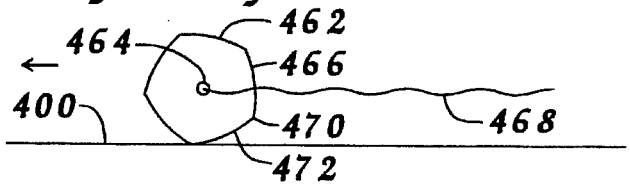
Figure 17G:
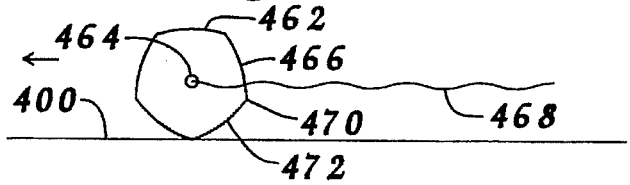
Figure 18A:
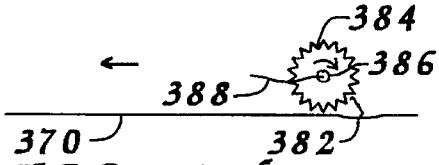
FIG. 18*a* through FIG. 18*g* are plan views of a rotary cutting head illustrating a cutting procedure.
Figure 18B:
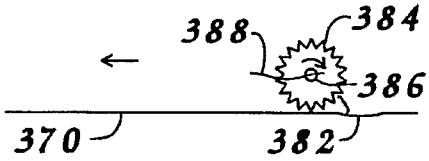
Figure 18C:
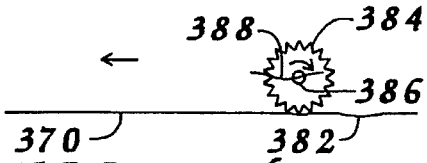
Figure 18D:
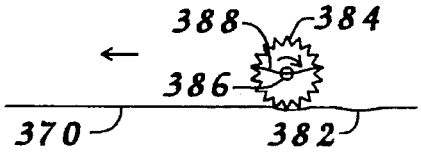
Figure 18E:
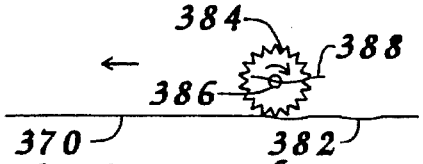
Figure 18F:
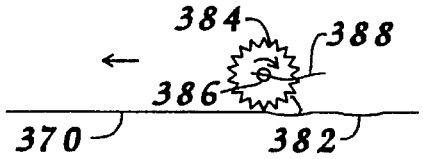
Figure 18G:
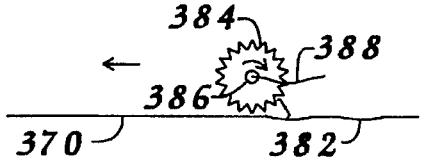

FIG. 17*a* through FIG. 17*g* depict the camming roll of a cam wheel 462 through one camming group 466. Cam wheel 462, having an axle 464, creates a cam wheel tracking line 468 during such motion along surface 400. Cam wheel 462 contains five camming groups 466. Camming group 466 contains a minimum radius measurement position 472 and a maximum radius measurement position 470 with both measurements made from axle 464. FIG. 17*a* and FIG. 17*g* place maximum radius measurement positions 470 in contact with surface 400 while FIG. 17*d* places minimum radius measurement position 472 in contact with surface 400.

FIG. 18*a* through FIG. 18*g* illustrate the direct transference of cam wheel tracking line 468 shown in FIG. 17*a* through FIG. 17*g* to a rotary cutting head tracking line 388. An axle 386 of rotary cutting head 384 receives a transference of motion from cam wheel tracking line 468 of FIG. 17*a* through FIG. 17*g* as disclosed elsewhere. A direction of travel is indicated as well as rotational direction of rotary cutting head 384. A depression 382 is shown preinstalled with a second depression 382 being installed during completion of the series. Due to the gradual transition from downward movement to upward movement milling through of the cut is performed. Significant longitudinal movement of rotary cutting head 384 occurs while in contact with asphalt surface 370.

Figure 19A:
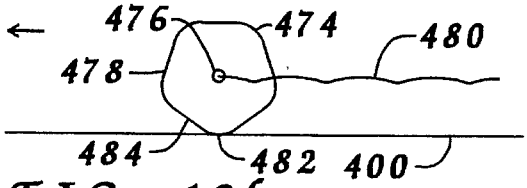
FIG. 19*a* through FIG. 19*g* are plan views of a cam wheel having five camming groups illustrating the motion of the axis line during rotation.
Figure 19B:
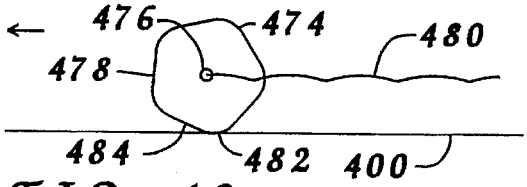
Figure 19C:
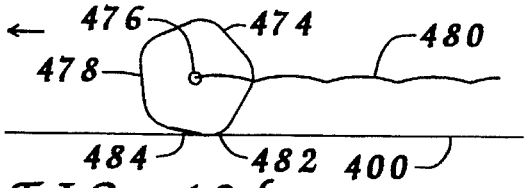
Figure 19D:
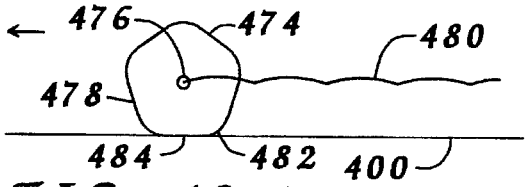
Figure 19E:
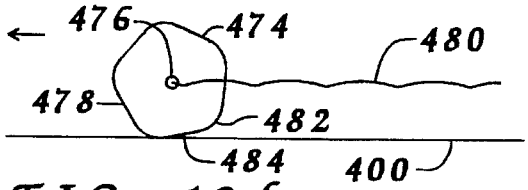
Figure 19F:
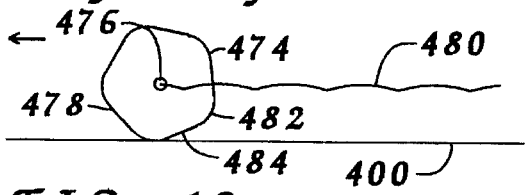
Figure 19G:
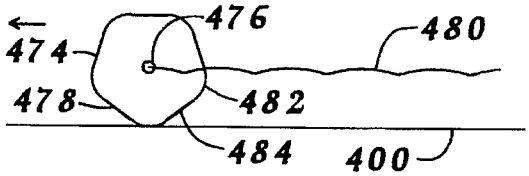

FIG. 19*a* through FIG. 19*g* depict the camming roll of a cam wheel 474 through one camming group 478. Cam wheel 474, having an axle 476, creates a cam wheel tracking line 480 during such motion along surface 400. Cam wheel 474 contains five camming groups 478. Camming group 478 contains a minimum radius measurement position 484 and a maximum radius measurement position 482 with both measurements made from axle 476. FIG. 1 9*a* and FIG. 19*g* place maximum radius measurement positions 482 in contact with surface 400 while FIG. 19*d* places minimum radius measurement position 484 in contact with surface 400. A significant circumferential distance of camming group 478 is simultaneously in contact with surface 400. This sudden movement through such a section of camming group 478 causes a sudden change in direction of cam wheel tracking line 480 from a downward movement to an upward movement.

Figure 20A:
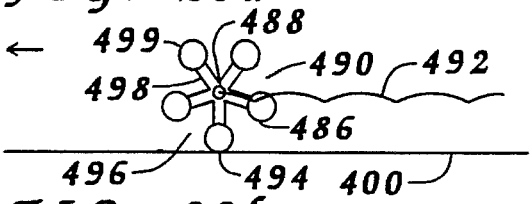
FIG. 20*a* through FIG. 20*g* are plan views of a cam wheel having five camming groups illustrating the motion of the axis line during rotation.
Figure 20B:
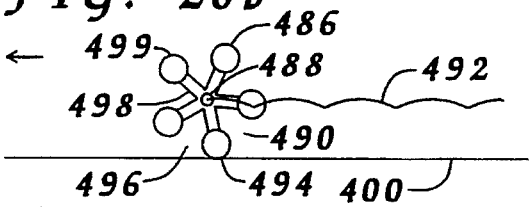
Figure 20C:
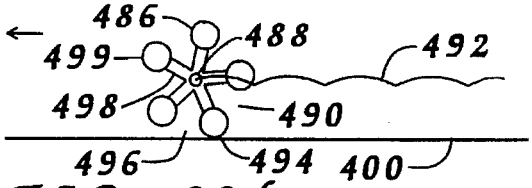
Figure 20D:
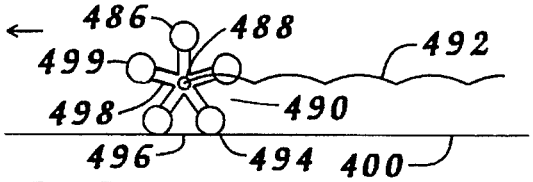
Figure 20E:
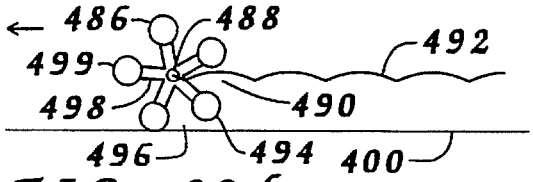
Figure 20F:
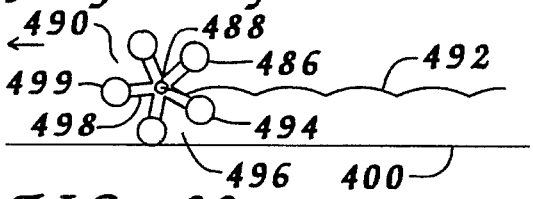
Figure 20G:
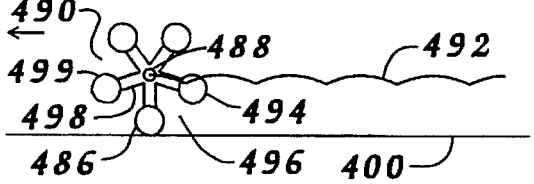

FIG. 20*a* through FIG. 20*g* depict the camming roll of a cam wheel 486 through one camming group 490. Cam wheel 486, having an axle 488, creates a cam wheel tracking line 492 during such motion along surface 400. Cam wheel 486 has five projections 498 which each have an end member 499. During revolution of cam wheel 486 the entire physical periphery does not come into contact with surface 400. Cam wheel 486 contains five camming groups 490 formed by the rotational profile of cam wheel 486. Camming group 490 contains a minimum radius measurement position 496 and a maximum radius measurement position 494 with both measurements made from axle 488. Minimum radius measurement position 496 is a position detached from cam wheel 486 corresponding to a position of contact with surface 400 during revolution of cam wheel 486. FIG. 20*a* and FIG. 20*g* place maximum radius measurement positions 494 in contact with surface 400 while FIG. 20*d* places minimum radius measurement position 496 in contact with surface 400. A significant circumferential distance of camming group 490 is simultaneously in contact with surface 400. This sudden movement through such a section of camming group 490 causes a sudden change in direction of cam wheel tracking line 492 from a downward movement to an upward movement.

Figure 21A:
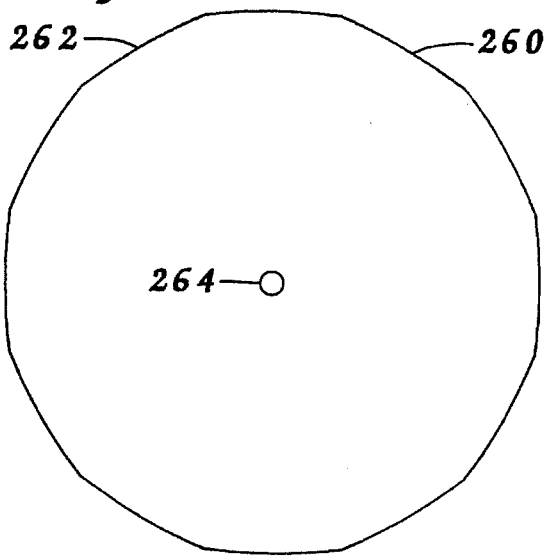
FIG. 21*a* is a plan view of a cam wheel having twelve camming groups.

FIG. 21*a* shows a cam wheel 260 having twelve camming groups 262. Each camming group 262 has a circumferential measurement of twelve inches. Each camming group 262 is curved in shape to provide gradual transference between downward movement of axle 264 and upward movement of axle 264. Therefore cam wheel 260 would travel longitudinally twelve feet during one complete revolution.

Figure 21B:
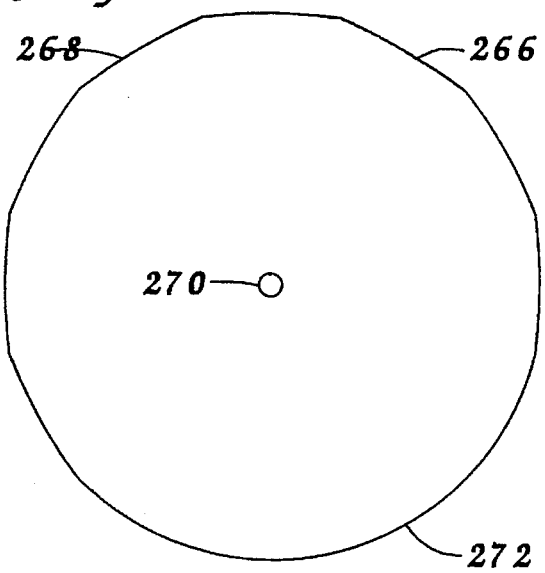
FIG. 21*b* is a plan view of a cam wheel having a skip pattern incorporated thereon.

FIG. 21*b* depicts a skip pattern cam wheel 266 having an axle 270, eight camming groups 268 and one skip section 272. With the exception of the replacement of four camming groups 268 by skip section 272, skip pattern cam wheel 266 is identical to cam wheel 260 shown in FIG. 21*a*.

Figure 22A:
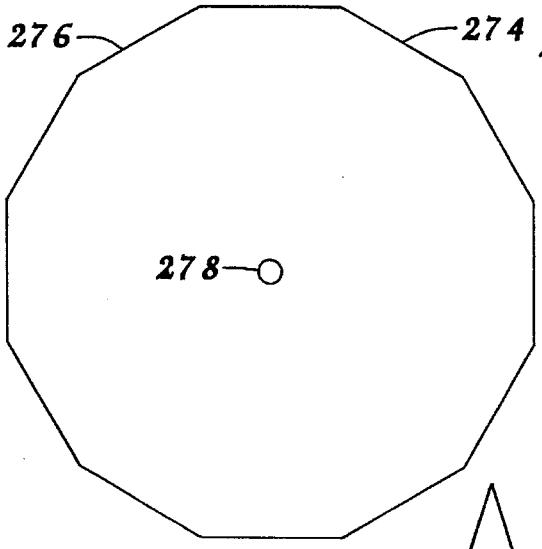
FIG. 22*a* is a plan view of a cam wheel having twelve camming groups.

FIG. 22*a* shows a cam wheel 274 having twelve camming groups 276. Each camming group 276 has a circumferential measurement of twelve inches. Each camming group 276 is relatively straight in shape to provide for a maximum elevational range of motion to axle 278. Therefore cam wheel 274 would travel longitudinally twelve feet during one complete revolution.

Figure 22B:
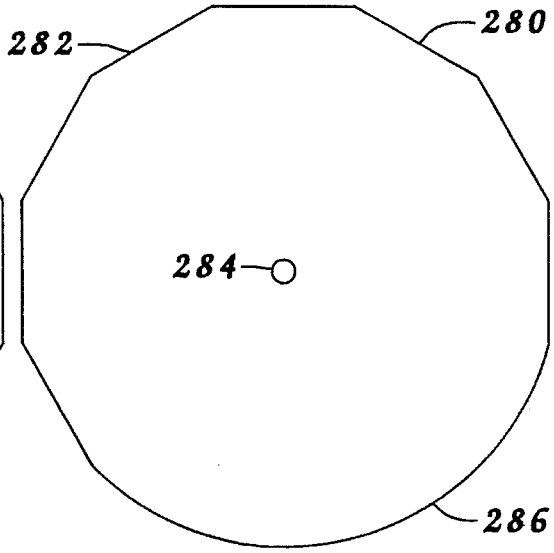
FIG. 22*b* is a plan view of a cam wheel having a skip pattern incorporated thereon.

FIG. 22*b* depicts a skip pattern cam wheel 280 having an axle 284, eight camming groups 282 and one skip section 286. With the exception of the replacement of four camming groups 282 by skip section 286, skip pattern cam wheel 280 is identical to cam wheel 274 shown in FIG. 22*a*.

Figure 23:
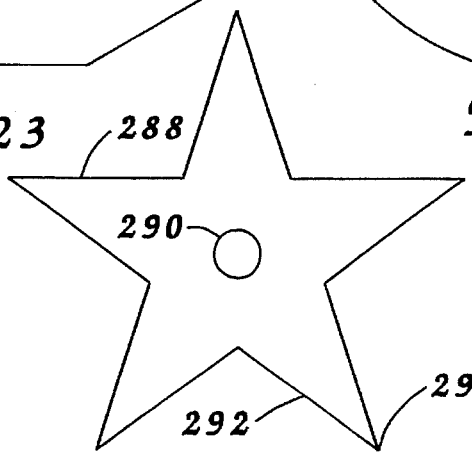
FIG. 23 is a plan view of a cam wheel having five camming groups.

FIG. 23 shows a five sided cam wheel 288 having an axle 290. Cam wheel 288 illustrates that the entire physical periphery of the cam wheel does not need to come into contact with the surface during the camming roll. In this example tips 294 of the projections 292 would come into contact with the surface with such tips being spaced exactly twelve inches from each adjacent tip. During one complete revolution of cam wheel 288 a rotational profile would be formed connecting the five tips 294 of projections 292.

Figure 24:
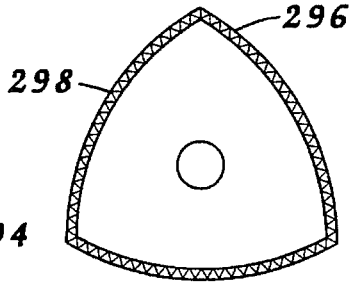
FIG. 24 is a plan view of a cam wheel having a traction enhancement attachments secured thereto.

FIG. 24 depicts the attachment of a traction enhancement material 298 to the periphery of cam wheel 296. Such attachment is well known in the art and exampled by vulcanize.

Figure 26:
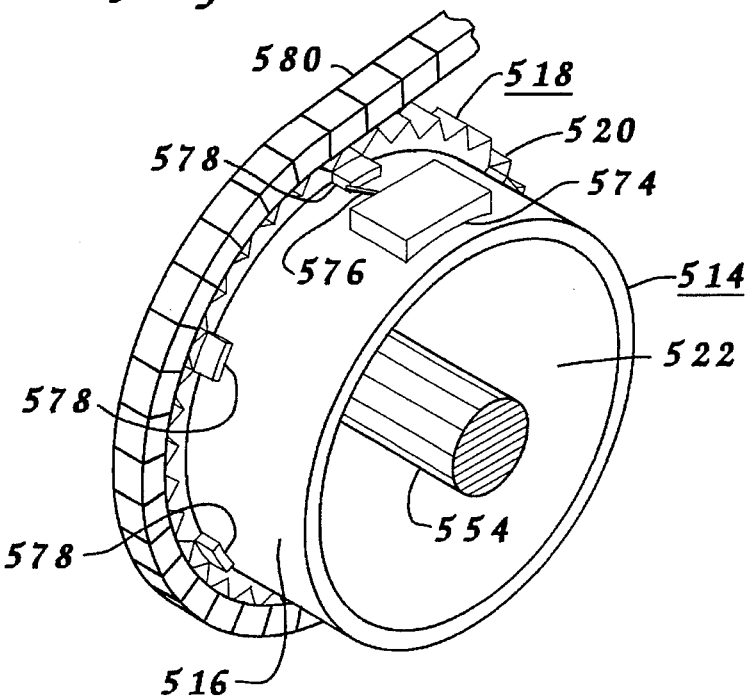
FIG. 26 is an enlarged perspective view of a section of the milling machine illustrated in FIG. 25.
Figure 27:
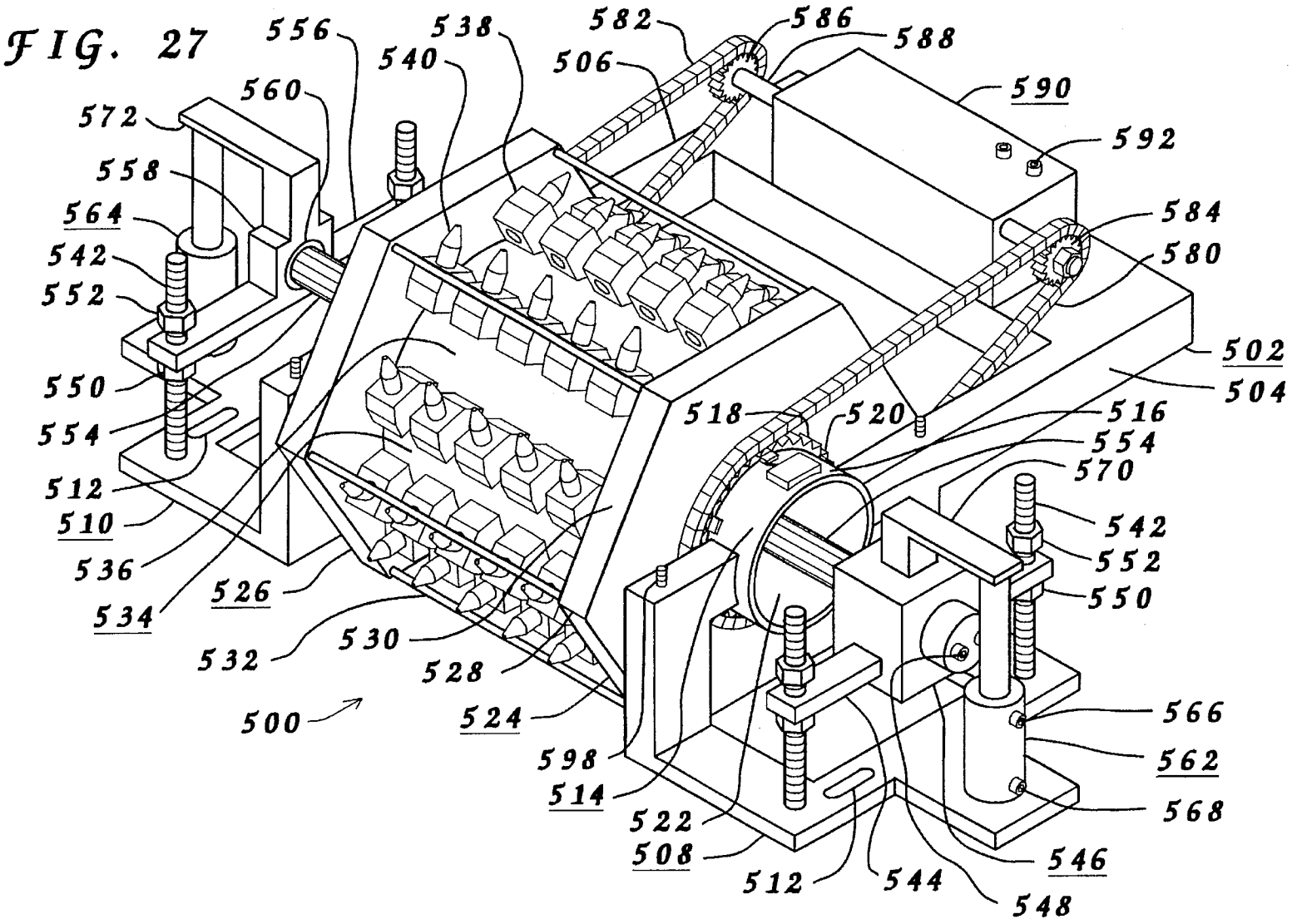
FIG. 27 is a perspective view of the milling: machine illustrated in FIG. 25 with the shroud removed.
Figure 28A:
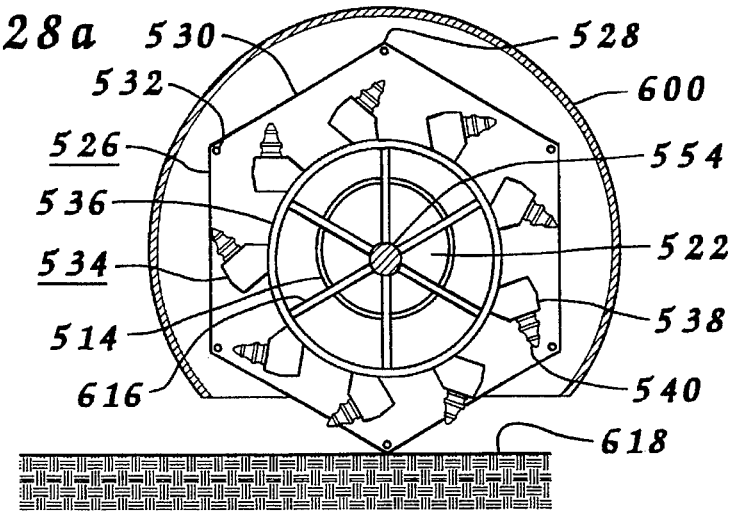
FIG. 28*a* through FIG. 28*c* are sectional views as taken from the section line 28*b* in FIG. 25 in various relational positions during movement of the machine.
Figure 28B:
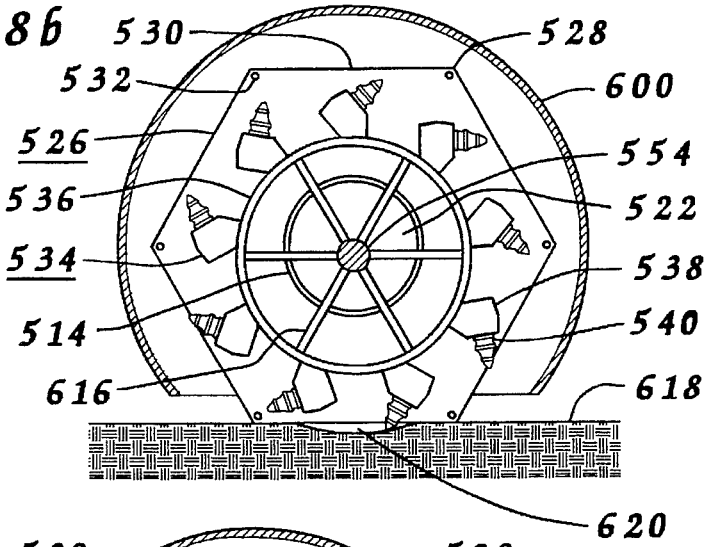
Figure 28C:
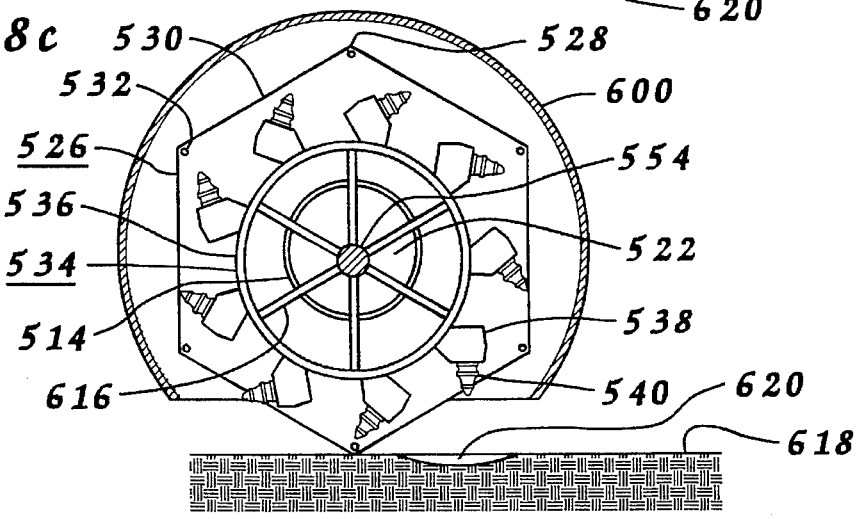

FIG. 25 through FIG. 27 and FIG. 28*a* through FIG. 28*c* show various views, or partial views therefrom, of a milling machine 500. FIG. 28*b* is an illustration as taken generally from the section lines shown in FIG. 25 for installation of SNAP type depressions 620, (FIG. 28*b* and FIG. 28*c*). FIG. 28*a* and FIG. 28*c* are adaptations of FIG. 28*b*.

Milling machine 500 is capable of installing a continuous series of SNAP type depressions. Milling machine 500 comprises a support structure which permits attachment to a transport vehicle, not shown. An attachment fork 502 having a first fork 504, a first support extension 508, a second fork 506 and a second support extension 510 form the basic support structure. Opposing access bearings 514 are secured to first fork 504 and second fork 506. Each access bearing 514 comprises an inner bearing member 516 and an outer bearing member 518 which are concentrically free turning to one another. Access bearing 514 has an access opening 522 of sufficient diameter to permit penetration and elevation adjustment therethrough of a cutting head drive shaft 554, more particularly described below. Each inner bearing member 516 is rigidly affixed to first fork 504 and second fork 506 respectively. The outer periphery of outer bearing member 518 has rigidly affixed thereto a sprocket 520.

A first camming member 524 and a second camming member 526, (FIG. 27), carry milling machine 500 relative to the surface under treatment as well as regulating the spacing and causing the lowering and raising action required to install the series of depressions. While several methods exist to permit rotation of the camming members relative to the support structure the use of a bearing is particularly expedient. Rigidly affixed to the inner periphery of each outer bearing member 518 is first camming member 524 and second camming member 526 respectively. First camming member 524 and second camming member 526 each have a plurality of camming groups having a raising contact surface 528 and a lowering contact surface 530. A plurality of coupling members 532 connect first camming member 524 and second camming member 526 in spaced relationship one to the other. First camming member 524 and second camming member 526 are therefore synchronized to rotate over the surface under treatment in unison. First camming member 524 and second camming member 526 are free turning relative to attachment fork 502.

Each of the depressions within the series is formed by a controlled cutting action performed on the surface under treatment. Situated between first camming member 524 and second camming member 526 is a cutting head 534. The cutting head can be of any suitable design capable of milling a surface. In a preferred embodiment cutting head 534 comprises a cutting drum 536 having a plurality of blocks 538 secured thereto each having installed therein a cutting tooth 540 as conventionally known in the art. Cutting head 534 is attached to cutting head drive shaft 554 utilizing cutting head coupling members 616, (FIG. 28*a* through FIG. 28*c*). Cutting head 534 is free turning relative to first camming member 524 and second camming member 526 as well as to attachment fork 502.

Elevational adjustment of the cutting head is required to ensure that each depression within the series of depressions is of the proper dimension and depth. While many elevation adjustment means exist a preferred embodiment has a pair of elevation units 542 attached to first support extension 508. A drive unit support 544 extends between the pair of elevation units 542 and is elevationally adjustable and selectively securable to a desired elevation utilizing lower locking members 550 and upper locking members 552. A cutting head drive unit 546 of any suitable design capable of providing rotation power to cutting head 534 is secured to drive unit support 544. In a preferred embodiment cutting head drive unit 546 receives hydraulic power utilizing hydraulic coupling 548 and converts such power. Cutting head drive unit 546 has attached thereto cutting head drive shaft 554 which is rotated as a result of the conversion of hydraulic power which in turn causes rotation of cutting head 534.

Supporting the opposing end of cutting head drive shaft 554 is a support bearing 560. The proper alignment of cutting head 534 relative to the surface under treatment is required to ensure that the resulting depressions are uniform. Attached to second support extension 510 is a pair of elevation units 542. A bearing support 556 extends between the pair of elevation units 542 and is elevationally adjustable and selectively securable to a desired elevation utilizing lower locking members 550 and upper locking members 552. A bearing housing 558 is secured to bearing support 556. Bearing housing 558 has installed therein support bearing 560 which receives cutting head drive shaft 554. Cutting head drive shaft 554 therefore is free turning relative to bearing support 556.

Milling machine 500 moves along a surface into which it is desired to install a series of depressions. Proportion can take many forms including being pushed, pulled or suspended from a transport vehicle such as a skid steer loader. A preferred embodiment provides for the rotation of the camming members to cause movement of milling machine 500. Such rotation can be accomplished utilizing a great many different power sources and power transfer means. A particularly expedient method provides a drive unit 590 receiving power utilizing hydraulic couplings 592 and converting such power into the controlled rotation of a drive shaft 588. Such power would be delivered by an accompanying vehicle such as a skid steer loader, not shown. Drive shaft 588 has attached thereto, at opposing ends, a first drive gear 584 and a second drive gear 586. A first drive chain 580 transfers rotation of first drive gear 584 to sprocket 520 which is rigidly attached to outer bearing member 518. Outer bearing member 518 is attached to first camming member 524. A second drive chain 582 similarly transfers rotation from second drive gear 586 to second camming member 526.

While self contained drive means have been disclosed, utilization of movement by a transport vehicle, by pushing or pulling is disclosed, while first camming member 524 and second camming member 526 free turn relative to, and as a result of, the passage across the surface under treatment.

Figure 25:
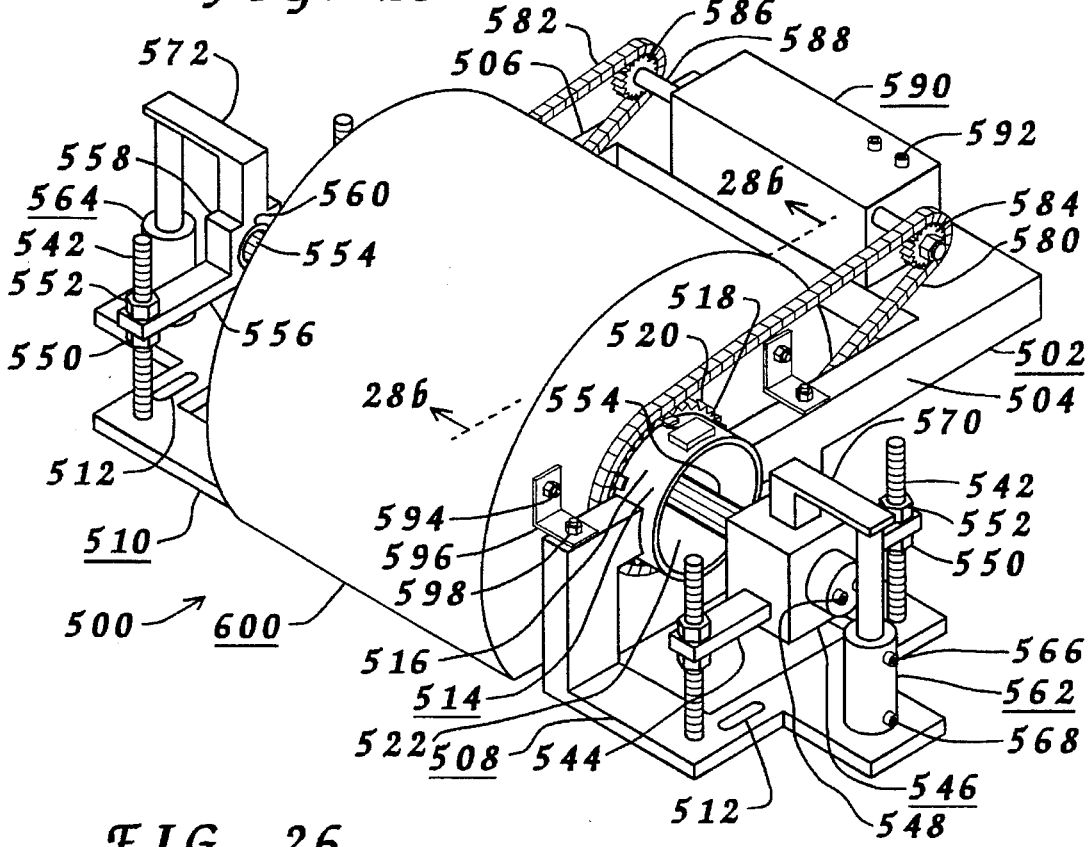
FIG. 25 is a perspective view of a milling machine.

A shroud 600, shown removed in FIG. 27, is attached to attachment fork 502 utilizing a plurality of shroud brackets 596 each secured by a bolt 594 and a nut 598, (FIG. 25). Shroud 600 provides containment of and protection from debris caused by the cutting action of milling machine 500.

Installation of a continuous series of SNAP type depressions utilizing milling machine 500 could be performed with cutting head 534 adjusted and secured to a predetermined elevation utilizing elevation units 542 as illustrated in FIG. 25 or with alternating positions relative to elevation units 542 as illustrated in FIG. 27 with first hydraulic unit 562 and second hydraulic unit 564 restricting cutting head 534 to a desired elevation relative to attachment fork 502. A support vehicle, not shown, would supply hydraulic power for transfer to milling machine 500 for cutting head drive unit 546, first hydraulic unit 562, second hydraulic unit 564 and drive unit 590. Power generation, such as hydraulic, could be incorporated into milling machine 500 with the operator riding or walking during such operation.

During formation of a continuous series of depressions cutting head 534 must come into contact with the surface under treatment during the lowering movement caused by the camming members. FIG. 28*a* Through FIG. 28*c* illustrate cutting head 534 at a cutting height elevation relative to the machine such that contact with road surface 618 is possible during rotation of second camming member 526. Thus a depression 620 is installed in road surface 618 during the passage of each camming group while in this relative position.

Occasionally SNAP depressions require incorporation of a skip pattern within the series of depressions. One example places eight depressions as conventionally spaced followed by the uncut surface normally receiving four depressions. This pattern being repeated to form the series. Several variations exist to prevent the cutting head from coming into contact with the surface under treatment during the skip section of the series. A preferred embodiment has the cutting head elevated to eliminate contact during the lowering procedure caused by the camming members. To facilitate this elevational adjustment a first hydraulic unit 562 is attached to first support extension 508 and, utilizing a connection member 570, to cutting head drive unit 546. A second hydraulic unit 564 is attached to second support extension 510 and, utilizing a connection member 572, to bearing housing 558. First hydraulic unit 562 and second hydraulic unit 564 each have an upper hydraulic coupling 566 and a lower hydraulic coupling 568 to receive extension and retraction power as conventionally known in the art.

During the installation of a series of depressions having a skip pattern it is necessary to determine when the proper number of depressions have been installed and to cause the selective elimination of installation at the proper time. It is then necessary to determine when the proper distance has been passed to cause the selective resumptions of installation. Many measuring means exist with a preferred embodiment provides for attachment to inner bearing member 516 of a counter 574 having a toggle 576. Attached to outer bearing member 518 are a plurality of blocks 578 matching the number and proportional spacing of the camming groups of first camming member 524 and second camming member 526. Outer bearing 518 would rotate relative to the rotation of first camming member 524 and second camming member 526. Therefore one of the blocks 578 would come into contact with toggle 576 and pass counter 574 for the passage of each camming group of first camming member 524 and second camming member 526 during rotation over the surface under treatment. Counter 574 would cause simultaneous activation of first hydraulic unit 562 and second hydraulic unit 564 utilizing any of the methods commonly known in the art.

Figure 29A:
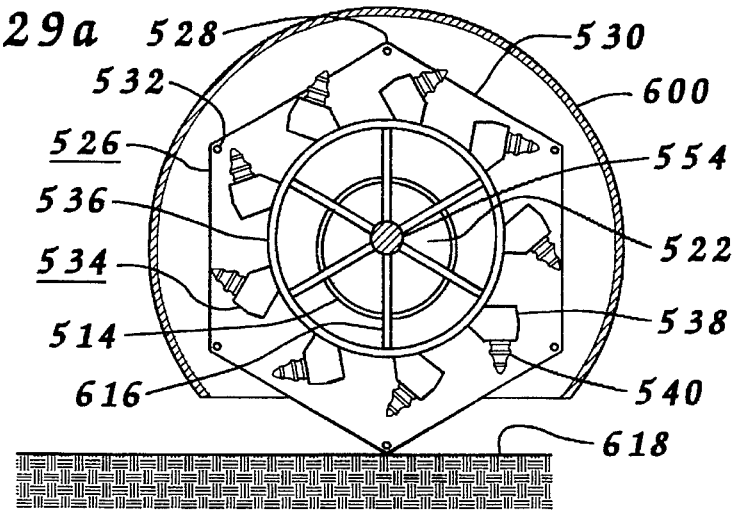
FIG. 29*a* through FIG. 29*c* are sectional views from FIG. 28*a* through FIG. 28*c* in various relational positions during movement illustrating a skip height elevation relative to the machine.
Figure 29B:
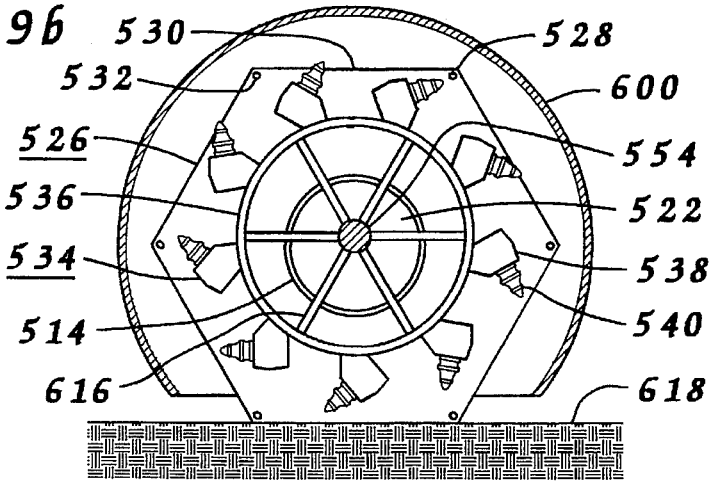
Figure 29C:
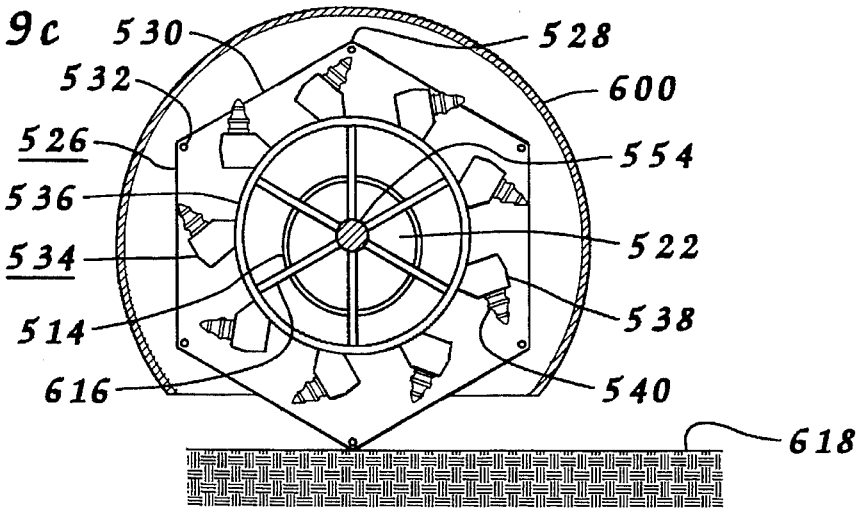

During formation of a series of depressions having a skip pattern incorporated therein cutting head 534 must not come into contact with the surface during passage over the skip section. While several different methods can be utilized to prevent contact by cutting head 534 during such passage, a particularly expedient method is to elevate cutting head 534 to a height where contact is not possible. FIG. 29*a* through FIG. 29*c* illustrate cutting head 534 at a skip height elevation relative to the machine such that contact with road surface 618 is not possible during rotation of second camming member 526. Thus no depression is installed in road surface 618 during passage of each camming group while in this relative position.

During the formation of the skip pattern the cutting head is raised to prevent contact with the surface under treatment during a predetermined travel distance within the series. In a preferred embodiment this is made possible by the large opening in the sides of the camming members so that the shaft can be moved vertically. Installation of a series of SNAP depressions having a skip pattern utilizing milling machine 500 could utilize selective alternating elevations as illustrated in FIG. 28*a* through FIG. 28*c* and FIG. 29*a* through FIG. 29*c*.

FIG. 27 illustrates lower locking members 550 and upper locking members 552 adjusted on elevation units 542 to permit alternating positions of cutting head drive shaft 554, and therefore cutting head 534, utilizing selective manipulation of first hydraulic unit 562 and second hydraulic unit 564. Referring specifically to FIG. 26 counter 574 would register the passage of blocks 578, and therefore the camming groups of the camming members, and activate first hydraulic unit 562 and second hydraulic unit 564 following the passage of a predetermined number of camming groups to place cutting head 534 at an elevated relative height, as illustrated in FIG. 29*a* through FIG. 29*c*. During the passage of this group of camming groups, prior to activation of first hydraulic unit 562 and second hydraulic unit 564, a depression 620 would be formed in road surface 618 under treatment for each of the camming groups, as illustrated by FIG. 28*a* through FIG. 28*c*. Following passage of this predetermined number of camming groups cutting head 534 would be elevated and passage of a predetermined number of camming groups would be registered by counter 574. During the passage of this group of camming groups no depressions would be formed in road surface 618 under treatment, as illustrated by FIG. 29*a* through FIG. 29*c*.

Adaptation of this general method of providing alternating positions for the cutting head relative to the general machine is applicable to the other embodiments disclosed herein. It further being noted that such-counting of the passage of camming groups is adaptable to linkage directly to the cam member or to a separate measuring device moving across the surface under treatment relative to the passage of the cam member. While alternating positions for the cutting head relative to the support structure are taught, blocking means to prevent contact by the cutting head with the surface under treatment is envisioned and disclosed.

In addition to being capable of installing continuous SNAP type depressions and depressions in a series having a skip pattern incorporated therein, milling machine 500 is operable for static operation for continuous milling. Static operation is a procedure which removes a predetermined amount of the upper surface in a continuous manner as exampled by removing the upper half inch of surface prior to resurfacing.

Figure 30:
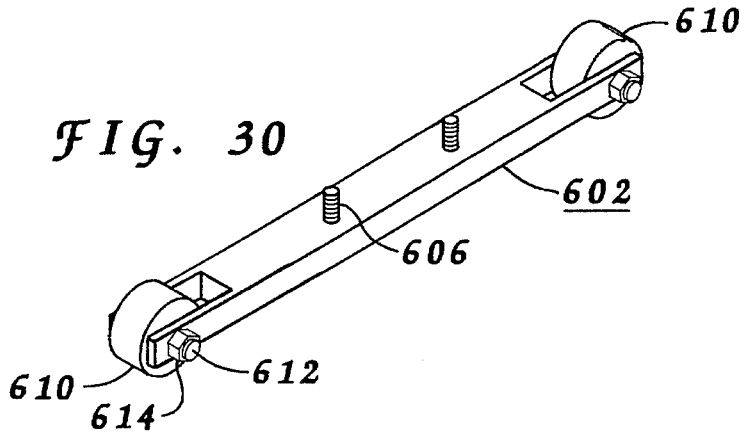
FIG. 30 is a perspective view of a static operation attachment.
Figure 31:
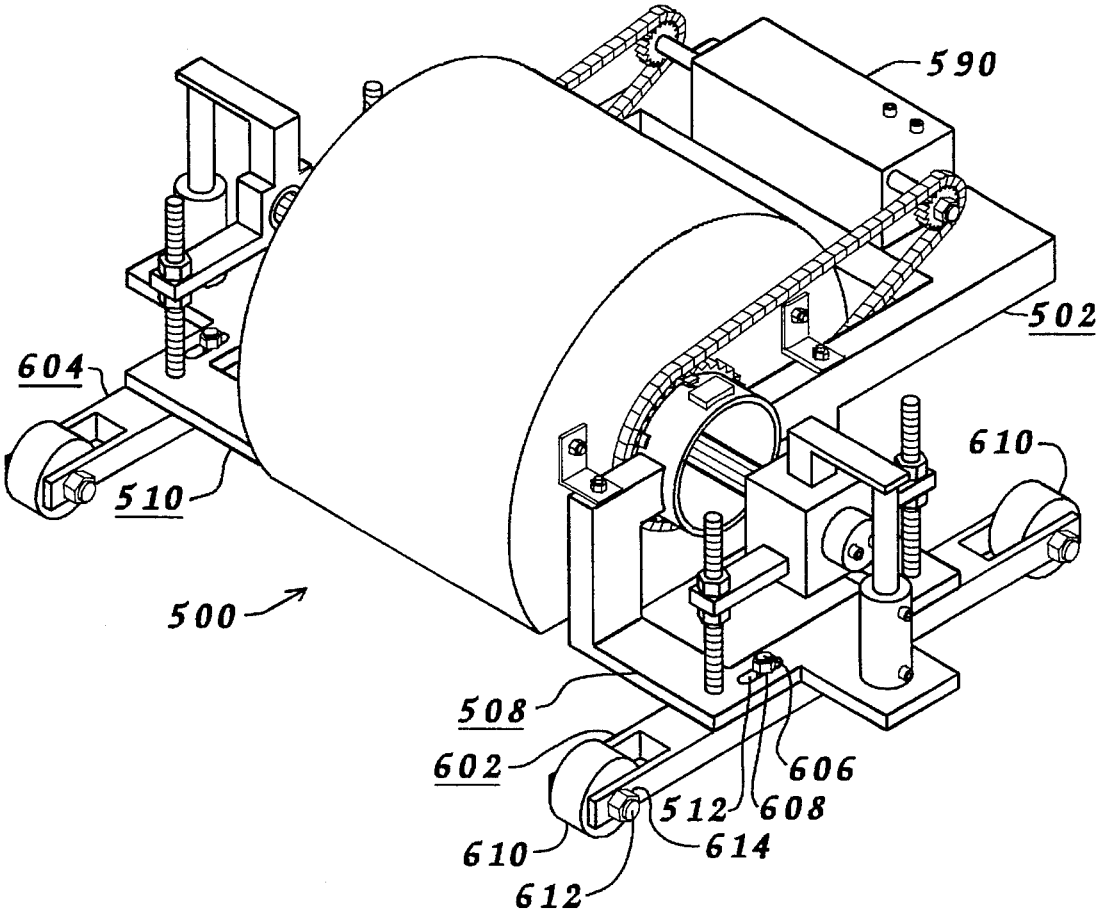
FIG. 31 is a perspective view of the milling machine of FIG. 25 with static operation attachments affixed.

FIG. 31 illustrates a configuration for continuous static milling. Such operation involves the attachment of first static operation attachment 602, more particularly detailed in FIG. 30, and second static operation attachment 604 to milling machine 500. First static operation attachment 602 and second static operation attachment 604 are attachable to milling machine 500 utilizing attachment slots 512, attachment bolts 606 and attachment nuts 608. Each static operation attachment 602 and 604 have opposing support wheels 610 rotably attached thereto utilizing a support axle 612 and locking members 614. Cutting head 534, not shown, is positioned at a fixed elevation utilizing the selective adjustment relative to elevation units 542 and securement thereto utilizing lower locking members 550 and upper locking members 552. Drive unit 590 can be rendered inoperable during such an operation, or the camming members 524 and 526, not shown, would be otherwise locked to a stationary position, therefore cutting head 534, not shown, would remain at a predetermined elevation to the support surface being an asphalt surface under treatment. Movement of milling machine 500 would be facilitated by a support vehicle, not shown, which would also supply hydraulic power for operation of the cutting head.

Many of the various camming members can be utilized within the general design of milling machine 500. A preferred embodiment places six camming groups on each camming member. While various specifications exist for SNAP type depressions, the dimensions detailed previously are common and result in the requirement of one depression per foot with a five inch uncut section between each depression and a depth of between one-half and five-eights inch. A current standard for skip patterns eliminates one third of the cuts within each series of twelve placing eight depressions based on the above spacing followed by an uncut section equal to the normal placement of four depressions. Based upon these requirements camming members having a diameter, measured across center from raising contact surface to opposing raising contact surface, of twenty four inches result. Within this embodiment the lowering contact surface would be straight and connect each raising contact surface with the adjacent raising contact surfaces. This results in a distance between adjacent raising contact surfaces of exactly twelve inches, which is the desired spacing of the resulting depressions. Utilization of a cutting head having an rotational diameter of twenty two inches will, when proper adjustment is made to the elevational height for cutting depth, install nearly perfect depressions having the proper spacing, individual dimensions and the proper depth.

Various cam members elsewhere disclosed, or adaptations therefrom, are applicable to incorporation into the general design of this chariot style embodiment of milling machine 500.

Figure 32:
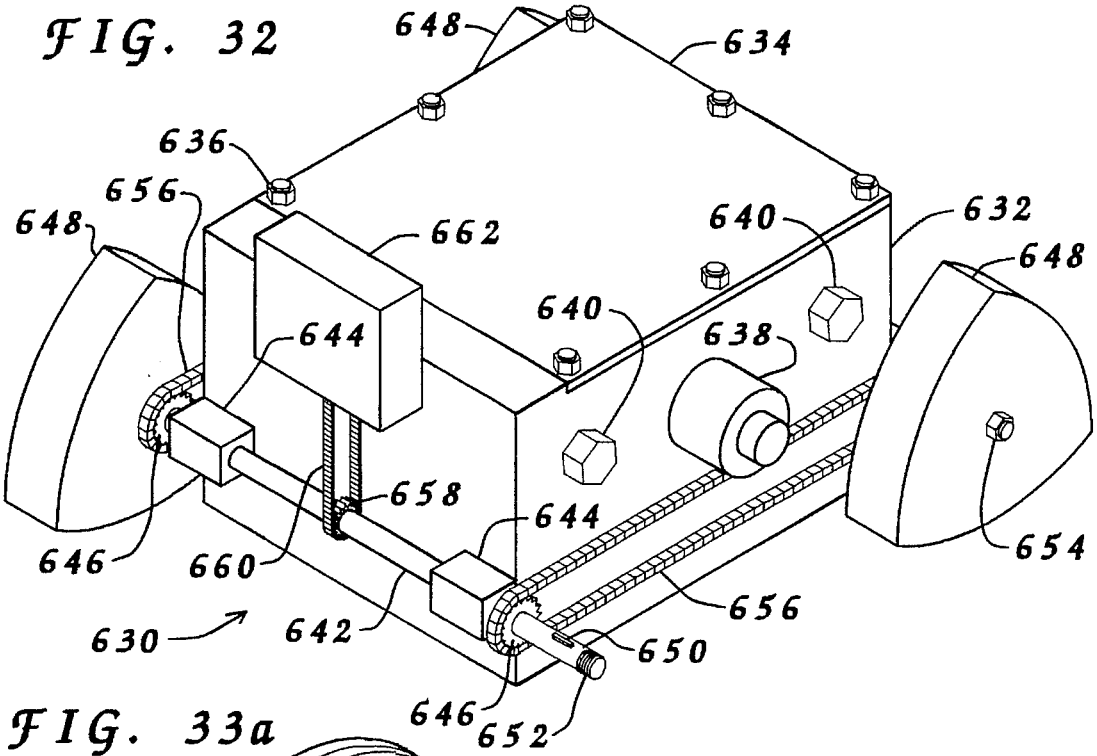
FIG. 32 is a perspective view of a milling machine.

FIG. 32 shows a depression installation machine 630 which examples uniform elevation of the cutting head, not shown, to form a continuous series of SNAP type depressions. A housing 632, having a access cover 634 secured by bolts 636 contains the cutting head. While numerous power transfer means exists such as electric, internal combustion or hydraulic amongst others, a preferred embodiment is hydraulic transfer. A cutting head drive 638 receives hydraulic power transfer from a transport vehicle, not shown, and drives the cutting head. Adjustment of the cutting head is provided by a plurality of cutting head adjustments 640 which permit proper elevational adjustment as well as horizontal alignment adjustment.

The synchronized turning of camming members 648 is required for proper operation. Four camming members 648 are provided, with one shown removed for illustrative purposes, which rotate in unison to raise and lower the machine during movement across the surface under treatment. Opposing axles 642 are housed in axle housings 644 which have bearing member, not shown. A locking member 650 cooperates with a nut 654 to secure each camming member 648 to their respective axle 642. Each axle 642 has secured on opposing ends a transfer sprocket 646 which receives a coupling chain 656. Thus the four camming members are linked to rotate in a synchronized manner during movement.

While movement of depression installation machine 630 can be facilitated by numerous means including propulsion by a transport vehicle, a particularly expedient methods is to have the machine rotate camming members 648 to provide for the forward motion. A drive unit 662 receives hydraulic power from the transport vehicle, converts such power, and causes the controlled rotation of a drive chain 660. Drive chain 660 is linked to a drive sprocket 658 which is rigidly secured to one axle 642.

Figure 33A:
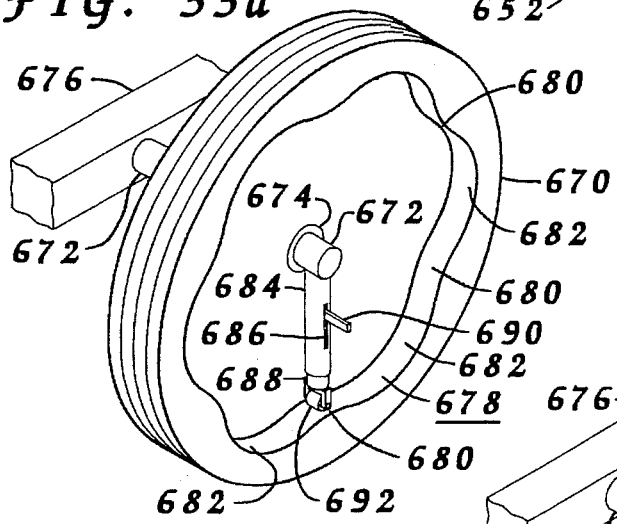
FIG. 33*a* and FIG. 33*b* are perspective views of a cam member having an open interior cam surface showing alternative height positions.
Figure 33B:
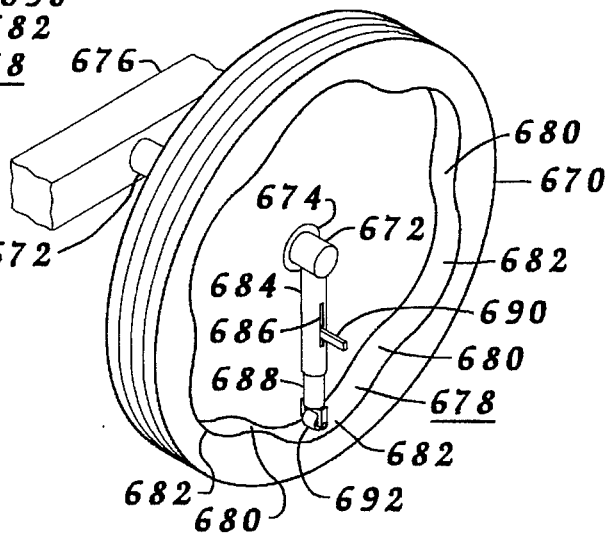

FIG. 33*a* and FIG. 33*b* are examples of moving the camming surface out of direct contact with the surface under treatment. A support wheel 670 would contact the surface under treatment and rotate as a result of movement over such surface. A secondary method places support wheel 670 in contact with an axle or some other suitable unit of the transport vehicle which rotates as a result of movement across the surface under treatment.

Support wheel 670 has an axle 672 mounted in a bearing 674 and extending to a support member 676 which is part of the transport vehicle. Extending downward from axle 672 is a guide member 684 which remains vertical during usage and has incorporated therein a slot 686. Free standing within guide member 684 is an insert member 688 which has extending therefrom, through slot 686, an elevation member 690. Affixed to the distal end of insert member 688 is a roller 692.

An open interior cam surface 678 extends completely around the interior of support wheel 670. Open interior cam surface 678 is comprised of a plurality of camming groups formed by a raising surface 680 and a lowering surface 682. The example illustrated has six camming groups formed by six raising surfaces 680 and six lowering surfaces 682. The relative distance from the highest point on each raising surface 680 to the periphery of support wheel 670 is greater than the lowest point on each lowering surface 682 to the periphery of support wheel 670.

As roller 692 moves along open interior cam surface 678 during rotation of support wheel 670 insert member 688, and therefore elevation member 690, is forced upward and allowed to move downward repeated. The cutting head, not shown, would be in direct communication with elevation member 690 to bring the cutting head into contact with the surface under treatment, the position illustrated in FIG. 33*b*, and to take the cutting head out of contact with the surface, the position illustrated in FIG. 33*a*, to form the desired series of depressions.

Spacing for the resulting depressions would be based upon the circumference of support wheel 670 and the number of camming groups contained on open interior cam surface 678. While variations exist a preferred embodiment places at least two support wheel 670 synchronized to turn in unison supporting the cutting head.

Figure 34:
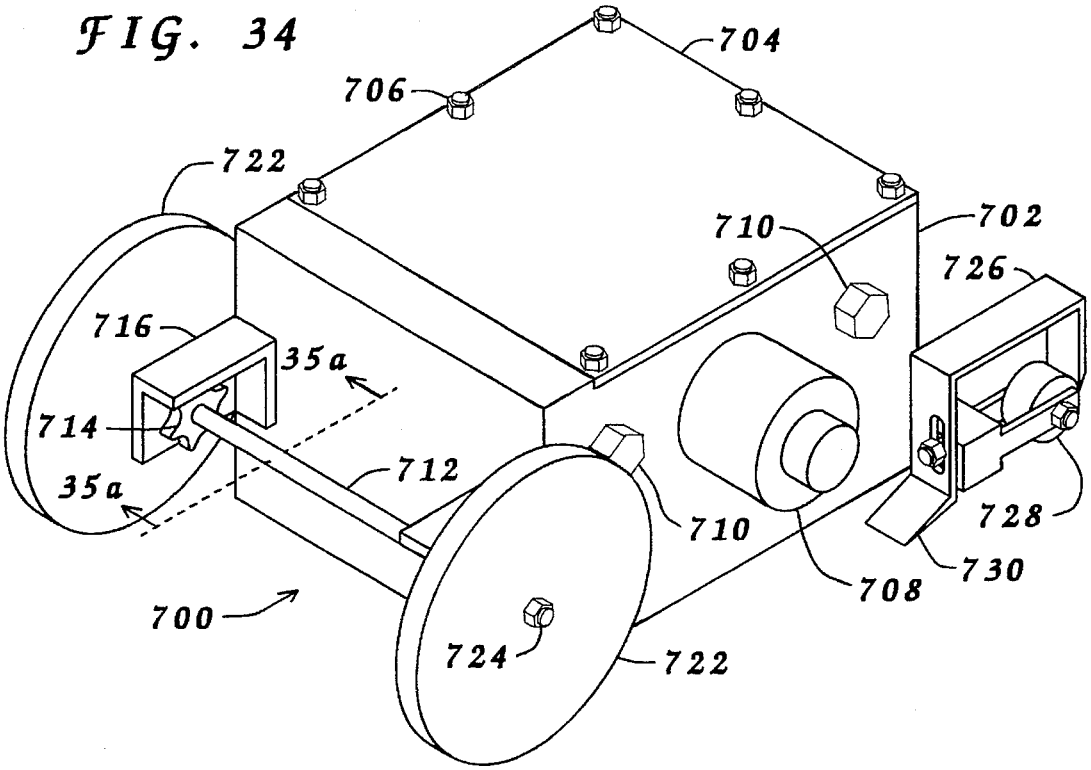
FIG. 34 is a perspective view of a milling machine.

FIG. 34 shows a depression milling machine 700 which examples the use of an axle to carry a camming member. The placement of the camming member on an axle is suitable for use with many of the various embodiments illustrated or otherwise disclosed. A particularly expedient embodiment provides a housing 702, having an access cover 704 secured by bolts 706, contains a cutting head, not shown, suitable to install depressions. The cutting head receives rotation power from a cutting head drive 708. Adjustment of the cutting head is facilitated by manipulation of a plurality of cutting head adjustments 710.

Figure 35A:
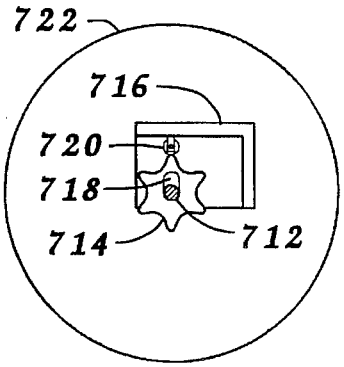
FIG. 35*a* is a sectional view as taken from the section line 35*a* in FIG. 34.
Figure 35B:
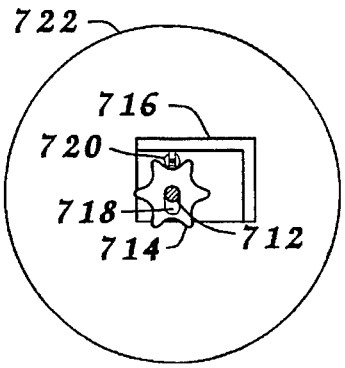
FIG. 35*b* is a sectional view from FIG. 35*a*.

An axle 712 extends through opposing axle slots, shown in FIG. 35*a* and FIG. 35*b*, in opposing camming housings 716. Camming housings 716 are rigidly secured to housing 702. Opposing support wheels 722 are secured to axle 712 utilizing bolts 724. Opposing camming members 714 are rigidly affixed to axle 712 and therefore rotate relative to the rotation of axle 712 which in turn rotates relative to the rotation of support wheels 722.

A roller 720, shown in FIG. 35*a* and FIG. 35*b*, is secured to each camming housing 716 and is in contact with camming member 714. Camming member 714 comprises a plurality of camming groups which cause the repeated elevational displacement of roller 720, and therefore camming housing 716, during rotation of camming member 714. FIG. 35*a* illustrates camming housing 716 at a raised elevational relationship to axle 712 while FIG. 35*b* illustrates camming housing 716 at a lowered elevational relationship to axle 712. Housing 702 therefore would move upward and downward repeatedly during rotation of support wheels 722.

A pivot point is provided by opposing support members 726 which are rigidly affixed to housing 702. A support wheel 728 is in direct contact with the surface under treatment. Path clearer 730 ensures a true tracking of the surface under treatment. As previously disclosed the pivot point has many possible locations relative to the cutting head and axle 712.

While a camming member attached to an axle has been disclosed, other variations exist including the use of a bend in the axle with the cutting head raised and lowered by the concentric movement of the bend.

The various features disclosed are suited to combinations to numerous to list herein. It is noted that such combinations are envisioned and disclosed.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling with the scope of the invention.

We claim:

1. A machine for cutting a series of depressions in a surface of a road, comprising;

a) at least one cutting head, the cutting head capable of milling the road surface to form one of said depressions;

b) at least one cam member, the cam member adaptable to rotate across the surface of the road as the machine is propelled across the road, the cam member having a plurality of camming groups, each of the camming groups providing for transferring a raising movement and a lowering movement to the cutting head, the lowering movement causing the cutting head to move into contact with the surface of the road to begin a cutting operation, the raising movement causing the cutting head to move out of contact with the surface of the road to terminate the cutting operation, the cutting operation forming one depression within the series of depressions;

whereby movement of the machine along the desired path will rotate the cam member, each complete rotation of the cam member causing the sequential lowering movement and raising movement of the camming groups, respectively causing the rotating cutting head to move down and into contact with the surface and up and out of contact with the surface to form a group of depressions during rotation of the cam member.

2. The machine defined in claim 1 further comprising a pivot point, the pivot point cooperating with the cam member to provide a pivotal movement to provide the raising movement and the lowering movement to the cutting head.

3. The machine defined in claim 2 wherein the cam member is interposed between the pivot point and the cutting head.

4. The machine defined in claim 2 wherein the cutting head is interposed between the cam member and the pivot point.

5. The machine defined in claim 2 wherein the pivot point is interposed between the cam member and the cutting head.

6. The machine defined in claim 1 further comprising measuring means and control means, the control means to provide selective elimination of the contact with the surface of the road by the cutting head during the lowering movement caused by the camming groups of the cam member, the measuring means adaptable to measure a first travel distance and a second travel distance, the first travel distance providing for selective activation of the control means, the second travel distance providing for selective deactivation of the control means; whereby during the activation of the control means the cutting head remains elevated above the surface of the road to insert a skip pattern into the series of depressions.

7. The machine defined in claim 6 wherein the measuring means is coupled to the cam member.

8. The machine defined in claim 1 wherein a first cam member is attached in close proximity to one end of the cutting head and a second cam member is attached in close proximity to the opposite end of the cutting head from the first cam member, the second cam member having a plurality of camming groups matching the camming groups of the first cam member, the first cam member and the second cam member adaptable to rotate in a synchronized manner; whereby the cutting head would be at least partially supported by two matching cam members synchronized to rotate in unison.

9. The machine defined in claim 1 wherein the camming groups of the cam member are symmetrically spaced along the cam member; whereby a continuous series of uniform depressions would be formed during rotation of the cam member.

10. The machine defined in claim 1 wherein the camming groups of the cam member further comprise a skip pattern, the skip pattern providing for elevation of the cutting head above the surface of the road during passage of the skip pattern during rotation of the cam member.

11. The machine defined in claim 1 wherein each depression within the series of depressions measure approximately seven inches across, approximately sixteen inches long, approximately one half inch deep with a spacing between adjacent depressions of approximately five inches.

12. The machine defined in claim 1 wherein the cutting head is rotary.

13. A machine for cutting a series of depressions in a surface of a road, the machine comprising;

a) a cutting head, the cutting head having a first end and a second end, the cutting head capable of milling the surface of the road to form one of the depressions;

b) a first cam member and a second cam member, the first cam member located in close proximity to the first end of the cutting head, the second cam member located in close proximity to the second end of the cutting head, the first cam member and the second cam member adaptable to rotate in a synchronized manner, the first cam member and the second cam member adaptable to rotate along the surface of the road as the machine is propelled along the road, the first cam member and the second cam member each having a plurality of camming groups, each of the camming groups providing for transferring a raising movement and a lowering movement to the cutting head, the lowering movement causing the cutting head to move into contact with the surface of the road to begin a cutting operation, the raising movement causing the cutting head to move out of contact with the surface of the road to terminate the cutting operation, the cutting operation forming one depression within the series of depressions;

whereby movement of the machine along the road will rotate the first cam member and the second cam member in unison, each complete rotation of the cam member causing the sequential lowering movement and raising movement of the cutting head, causing the cutting head to move down and into contact with the surface of the road and up and out of contact with the surface of the road to form a group of depressions during rotation of the cam members.

14. The machine defined in claim 17 further comprising measuring means and control means, the control means to provide selective elimination of the contact with the surface of the road by the cutting head during the lowering movement caused by the camming groups of the cam members, the measuring means adaptable to measure a first travel distance and a second travel distance, the first travel distance providing for selective activation of the control means, the second travel distance providing for selective deactivation of the control means; whereby during the activation of the control means the cutting head remains elevated above the surface of the road to insert a skip pattern into the series of depressions.

15. The machine defined in claim 14 wherein the measuring means is coupled to the cam members.

16. A method of cutting a series of depressions in a surface of a road comprising the steps of;

a) providing a self propelled vehicle;

b) providing a cutting tool, the cutting tool comprising at least one cutting head capable of forming one of said depressions in the road, the cutting head being attached to the self propelled vehicle;

c) providing movement to the cutting head of the cutting tool so as to enable the cutting head to form one of said depressions in the road;

d) providing a cam member, the cam member being adaptable to rotate across the surface of the road during usage, the cam member having a plurality of camming groups, each of the camming groups providing for transferring a raising movement and a lowering movement to the cutting head, the lowering movement causing the cutting head of the cutting tool to move into contact with the surface of the road to begin a cutting operation, the raising movement causing the cutting head of the cutting tool to move out of contact with the surface of the road to terminate the cutting operation, the cutting operation forming one depression within the series of depressions;

e) placing the cam member in contact with the surface of the road;

f) propelling the cutting tool over the surface of the road along a desired path of the series of depressions utilizing the self propelled vehicle, thereby causing rotation of the cam member causing each of the camming groups to come into contact with the surface of the road in a successive manner while causing the lowering movement and the raising movement to be performed during the passage of each camming group over the surface of the road;

whereby the self propelled vehicle travels along the desired path, and the lowering movement and the raising movement are generated by each camming group of the cam member as the cam member moves over the surface of the road, causing the cutting head to move down and into contact with the surface and up and out of contact with the surface to form a group of depressions during a single rotation of the cam member to cooperate during subsequent rotations of the cam member to form the desired series of depressions.

17. The method defined in claim 16 wherein each of the depressions within the series of depressions measure approximately seven inches longitudinally, approximately sixteen inches in width, approximately one half inch deep with a spacing longitudinally between adjacent depressions of approximately five inches.

18. An apparatus for forming a series of depressions in the surface of a road, comprising;

a) a cutting head capable of forming one of said depressions in the road;

b) support structure for the cutting head;

c) at least one cam member, said cam member being operatively rotatable by movement of the apparatus over the surface of the road, the cam member having at least one camming surface for causing said support structure and said cutting head to move between first and second heights relative to the surface of the road, said cutting head being out of contact with said surface at said first height, and said cutting head contacting the road surface at said second height to form one of said depressions;

whereby movement of said apparatus over the surface of the road will cause up and down movement of the cutting head to form a group of spaced depressions.

19. The apparatus of claim 18 wherein said cam member is a wheel having an open interior cam surface.

20. The apparatus of claim 18 wherein said apparatus is supported by at least one wheel, said wheel being connected to said cam member such that rotation of said wheel will cause movement of said cam member.

21. The apparatus of claim 18 wherein said apparatus is supported by at least two wheels, said wheels being connected by an axle, said cam member being rotated by rotation of said axle.

* * * * *